US009075373B2

(12) United States Patent
Hirata

(10) Patent No.: US 9,075,373 B2
(45) Date of Patent: Jul. 7, 2015

(54) DATA PROCESSING DEVICE, IMAGE FORMING DEVICE AND PROGRAM FOR INSTRUCTING PRINTING WITH DESIGNATION OF COPY COUNT

(75) Inventor: Masaru Hirata, Tokyo (JP)

(73) Assignee: Oki Data Corporation, Tokyo (JP)

( * ) Notice: Subject to any disclaimer, the term of this patent is extended or adjusted under 35 U.S.C. 154(b) by 848 days.

(21) Appl. No.: 13/276,437

(22) Filed: Oct. 19, 2011

(65) Prior Publication Data

US 2012/0099138 A1 Apr. 26, 2012

(30) Foreign Application Priority Data

Oct. 21, 2010 (JP) ..... 2010-236531

(51) Int. Cl.
*G03G 15/00* (2006.01)

(52) U.S. Cl.
CPC .. *G03G 15/5087* (2013.01); *G03G 2215/00109* (2013.01)

(58) Field of Classification Search
None
See application file for complete search history.

(56) References Cited

U.S. PATENT DOCUMENTS 4,711,558 A * 12/1987 Tanioka et al. ..... 399/32
2007/0165248 A1* 7/2007 Utsunomiya et al. ..... 358/1.1
2008/0080008 A1* 4/2008 Yamamoto et al. ..... 358/1.18
2009/0103124 A1* 4/2009 Kimura et al. ..... 358/1.15

FOREIGN PATENT DOCUMENTS

JP A-08-30413 2/1996

* cited by examiner

*Primary Examiner* — Hilina K Demeter
(74) *Attorney, Agent, or Firm* — Muncy, Geissler, Olds & Lowe, P.C.

(57) ABSTRACT

A data processing device transmits a control command and print data to an image forming device. When a main controller causes a communication controller to transmit the print data to the image forming device, the main controller causes a memory part to save a setting data at least until the main controller receives a notification of print process completion, and causes a display part to display, for example, a copy count change screen that displays settings of the print data that is changeable by the input part.

15 Claims, 33 Drawing Sheets

(COPY COUNT AFTER CHANGE < COPY COUNT BEFORE CHANGE)

201 PRINT DATA ASSOCIATION SETTING DATA

| SETTING ITEM | VALUE |
|---|---|
| JOB TYPE | PRINT JOB |
| COPY COUNT | 10 |
| COMPUTER NAME | PC1 |
| IP ADDRESS | 123.123.123.123 |
| PORT NAME | LPR |

Fig. 16

202 PRINT INTERRUPTION COMMAND ASSOCIATION SETTING DATA

| SETTING ITEM | VALUE |
|---|---|
| JOB TYPE | COMMAND |
| JOB ID | aaaa |
| COMPUTER NAME | PC1 |
| IP ADDRESS | 123.123.123.123 |
| PORT NAME | LPR |

Fig. 17

203 COPY COUNT CHANGE COMMAND ASSOCIATION SETTING DATA

| SETTING ITEM | VALUE |
|---|---|
| JOB TYPE | COMMAND |
| JOB ID | aaaa |
| COPY COUNT | 1 |
| COMPUTER NAME | PC1 |
| IP ADDRESS | 123.123.123.123 |
| PORT NAME | LPR |

Fig. 18

701 PRINT DATA ASSOCIATION SETTING DATA

| SETTING ITEM | VALUE |
|---|---|
| JOB TYPE | PRINT JOB |
| COPY COUNT | 10 |
| SCANNER NAME | Scanner1 |
| IP ADDRESS | 123.123.123.123 |
| PORT NAME | TCP/IP |

Fig. 27

702 PRINT INTERRUPTION COMMAND ASSOCIATION SETTING DATA

| SETTING ITEM | VALUE |
|---|---|
| JOB TYPE | COMMAND |
| JOB ID | aaaa |
| SCANNER NAME | Scanner1 |
| IP ADDRESS | 123.123.123.123 |
| PORT NAME | TCP/IP |

Fig. 28

703 COPY COUNT CHANGE COMMAND ASSOCIATION SETTING DATA

| SETTING ITEM | VALUE |
|---|---|
| JOB TYPE | COMMAND |
| JOB ID | aaaa |
| COPY COUNT | 1 |
| SCANNER NAME | Scanner1 |
| IP ADDRESS | 123.123.123.123 |
| PORT NAME | TCP/IP |

Fig. 29

DATA PROCESSING DEVICE, IMAGE FORMING DEVICE AND PROGRAM FOR INSTRUCTING PRINTING WITH DESIGNATION OF COPY COUNT

CROSS REFERENCE TO RELATED APPLICATION

The present application is related to, claims priority from and incorporates by reference Japanese patent application No. 2010-236531, filed on Oct. 21, 2010.

TECHNICAL FIELD

The present application relates to a data processing device that instructs printing with a designation of a copy count, an image forming device to be used in conjunction with the data processing device, and a program that realizes the data processing device. The term "copy count" in the specification means a number of copies to be printed as well as a number of copies have already been printed.

BACKGROUND

Data processing devices have been widely used that instruct printing to an image forming device with a designation of a copy count. The data processing device is configured as a personal computer (PC), for example. The image forming device is configured as a printer of MFP, for example. The "MFP" stands for a multi function printer, which is a printer with a facsimile function, a scanner function, a copy function and the like.

When the data processing device instructs printing of a document that the user created by application software, for example, the data processing device generates print data that includes a "print command (control command for instructing the image forming device to execute a print process)," "print instruction image data (drawing contents)" and the like and transmits the print data to the image forming device with setting data, such as "sheet size," "number of pages," "copy count," "file name," "user name (computer name)" and the like. Below, the print data with the setting data is also explained simply as "print data."

When the image forming device receives the print data from the data processing device, the image forming device once stores the received print data in a memory part. Then, the image forming device retrieves the print data stored in the memory part, analyzes the retrieved print data, and specifies the copy count and the like. In addition, the image forming device edits and develops (rasterizes) the print data and generates raster data, in which the drawing contents are dot-patterned, by editing and developing (rasterizing) the print data. Then, the image forming device execute a print process based the generated raster data. The term "editing" means a process to convert the drawing contents into an intermediate language. In addition, the term "developing (rasterizing)" means a process for converting the drawing contents that have been converted into the intermediate language, into a dot pattern.

As such an image forming device, there is a device that stores the print data received from the data processing device in the memory part even after the completion of the printing and that performs reprinting based on the print data stored in the memory part when the reprinting of the print data is instructed from the data processing device for a reason, such as the designated copy count being not enough (see Japanese Laid-Open Patent Application No. H8-30413).

However, as described below, the conventional data processing device and image forming devices have a problem that, if the designated copy count is too large, an extreme burden is added to the user to change the copy count.

For example, there is a case where the user mistakenly instructs the printing to the data processing device with the large copy count. In this case, the user controls the data processing device and cancels the print instruction once. Then, the user changes the print setting and instructs the reprinting.

The conventional data processing device and the conventional image forming device delete the print data when the print instruction is cancelled. Therefore, if the print instruction is cancelled, the user cannot reference the cancelled print data. For instructing the reprinting with different print settings, the user need to determine an appropriate setting for each print setting based on his memory and manually input all of the print settings again. This operation is burdensome and time consuming because the user needs to memorize the past print settings and to perform manual operation.

In addition, before the image forming device accepts a cancellation instruction for the print instruction, the user needs to count the copy count (or copy count) that the image forming device has printed, to determine whether or not there is any insufficient copy count. If there is insufficient copy count, the user needs to specify the insufficient copy count and change the print setting. Because this operation is also performed manually, it is burdensome and time consuming. Therefore, there is a problem with the conventional data processing device and image forming devices that, if the designated copy count is too large, an extreme burden is added to the user to change the copy count.

To solve the above-described problems, the present application has an object to provide a data processing device that eases the user's burden for changing the copy count when the designated copy count is too large and a program to realize the data processing device.

Furthermore, the present application has another object to provide an image forming device that is used in conjunction with the data processing device and that eases the user's burden for changing the copy count when the designated copy count is too large.

SUMMARY

A data processing device that transmits a control command and print data to an image forming device includes: a communication part that executes communication with the image forming device; an input part to which an instruction for the image forming device is inputted; a display part that displays images; a print data generator that generates the control command and the print data; a communication controller that controls the communication by the communication part; and a memory part that stores data including the print data; and a main controller that controls operation of the communication part, the input part, the display part, the print data generator, the communication controller and the memory part. When the main controller causes the print data generator to generate the print data and to associate setting data that includes copy count data that designates a copy count of the print data with the print data, and when the main controller causes the communication controller to transmit the print data, with which the setting data is associated, to the image forming device, the main controller causes the memory part to save the setting data at least until the main controller receives a notification, which indicates completion of a print process of the print data, from the image forming device, and the main controller causes the display part to display a screen, as a copy count change screen for instructing a change in the copy count, that displays settings of the print data that is changeable by the input part, the settings of the print data including the copy count designated by the copy count data.

According to the device disclosed in the application, it is possible to provide processing device and image forming devices that, if the designated copy count is too large, is able to ease the burden of the user to change the copy count. In another view, it is possible to provide an image forming device, which is used in conjunction with a data processing device, easing the burden of the user to change the copy count. Further, in another view, it is possible to provide a computer program executing the functions of the above devices.

BRIEF DESCRIPTION OF THE DRAWINGS

FIG. 16 is a first diagram illustrating a configuration example of setting data used in the first embodiment.

FIG. 17 is a second diagram illustrating the configuration example of the setting data used in the first embodiment.

FIG. 18 is a third diagram illustrating the configuration example of the setting data used in the first embodiment.

FIG. 27 is a first diagram illustrating a configuration example of setting data used in the second embodiment.

FIG. 28 is a second diagram illustrating a configuration example of setting data used in the second embodiment.

FIG. 29 is a third diagram illustrating a configuration example of setting data used in the second embodiment.

DETAILED DESCRIPTION OF EMBODIMENTS

Figure 1:
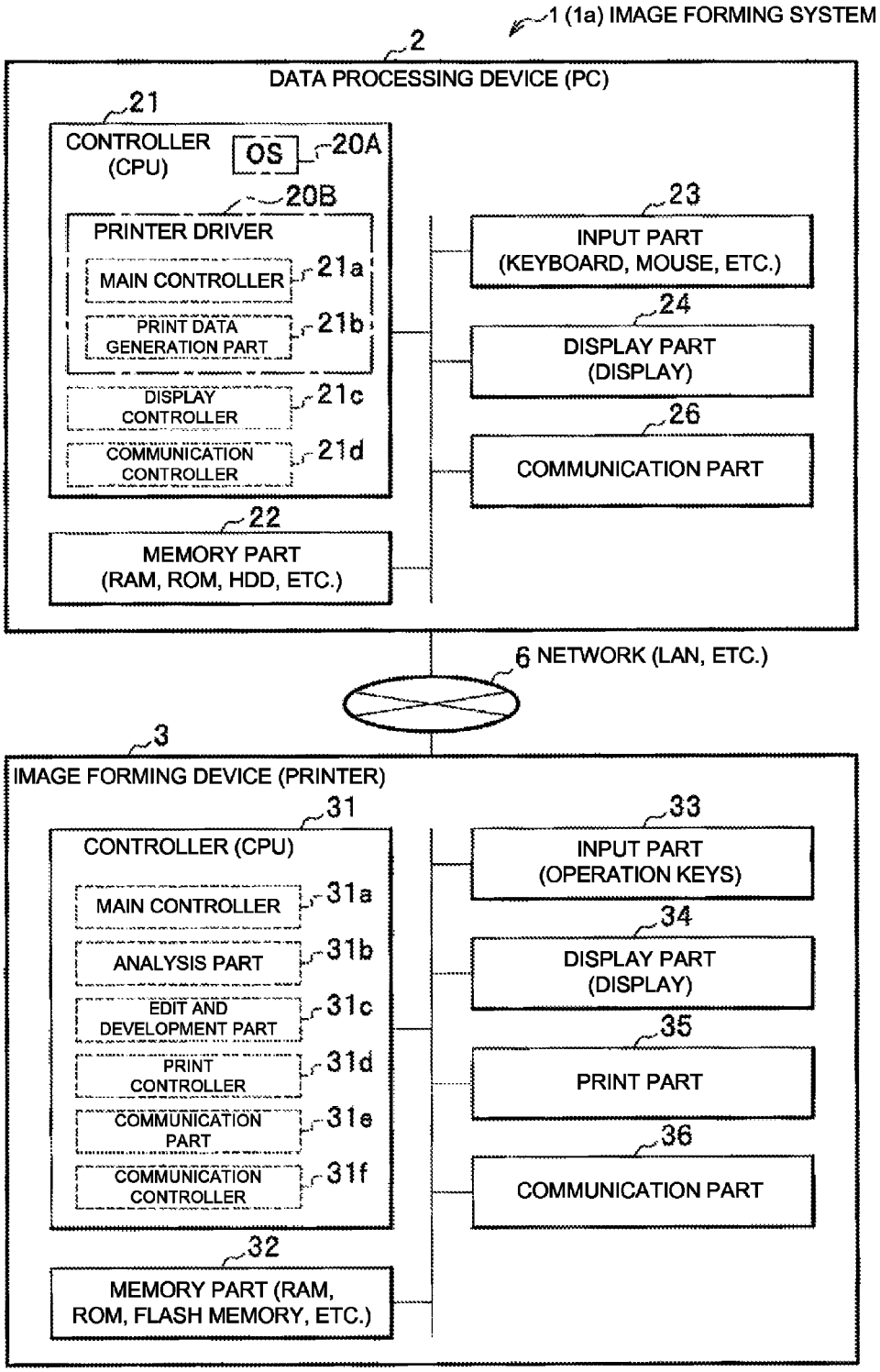
FIG. 1 illustrates a configuration of a data processing device and an image forming device according to a first embodiment.

Embodiments of the present application (hereinafter referred to as "embodiments") are described below in detail with reference to the drawings. Each drawing merely schematically illustrates the embodiments to allow sufficient understanding of the embodiments. Therefore, the embodiments are not limited to those shown in the drawings. In addition, in each drawing, common and similar components are marked with the same symbols, and duplicative explanations are omitted.

First Embodiment

<Configuration of Data Processing Device and Image Forming Device>

A configuration of a data processing device and an image forming device according to a first embodiment is explained below with reference to FIG. 1. FIG. 1 illustrates a configuration of a data processing device and an image forming device according to the first embodiment.

As shown in FIG. 1, a data processing device 2 and an image forming device 3 are communicatably connected through a network 6, such as a local area network (LAN) and the like, and form an image forming system 1 (1*a*). In the first embodiment 1, explanations are made with assumptions that the data processing device 2 is configured with a personal computer (PC), that the image forming device 3 is configured from a printer, and that the network 6 is configured from a LAN, for example. Transmission and reception of data between the data processing device 2 and the image forming device 3 are performed through the LAN 6.

First, the configuration of the data processing device 2 is explained. The PC 2, as the data processing device, includes a controller 21, a memory part 22, an input part 23, a display part 24 and a communication part 26.

The controller 21 is a component that controls the operation of the PC 2 and is realized as a central processing unit (CPU) executes a control program stored in a read-only memory (ROM), a hard disk drive (HDD) and the like. At the controller 21, an operating system (hereinafter referred to as "OS") 20A is operated, which is a basic program for managing the entire operation of the PC 2 and for providing usage environment that is common in various application programs. In addition, at the controller 21, a printer driver 20B is operated, which is a program for executing print processes at the printer 3. The control program and the OS may be provided in a computer readable medium, such as a compact disk (CD) and the like.

The memory part 22 is a component that stores various data and programs and is configured from a random access memory (RAM), ROM, HDD and the like. The RAM temporarily stores data and the like that are necessary for executing various application programs on the OS 20A, for example. In the ROM, a boot program for starting the OS 20A stored in the HDD is stored. The HDD stores the OS 20A, the printer driver 20B, various application programs, data and the like.

The input part 23 is a component by which the user inputs various data and instructions and is configured from a keyboard, a mouse and the like. The display part 24 is a component that displays various images and is configured from a display, such as a liquid crystal display (LCD) and the like.

The communication part 26 is a component that transmits and receives various data (including commands) and is configured from an input/output port. The communication part 26 transmits to the printer 3 through the LAN 6 print data generated by a print data generation part 21*b*, a print interruption command, a copy count change command and the like. The "print interruption command" is a control command that instructs the printer 3 to interrupt the print process being executed. The "copy count change command" is a control command that instructs the printer 3 to change a number of print copies (or copy count) of the print data and to resume the print process (to reprint).

The controller 21 functions as a main controller 21*a*, the print data generation part 21*b*, a display controller 21*c* and a communication controller 21*d*.

The main controller 21*a* is a functional part that controls operation of each part. The controller 21*a* configures the print data generation part 21*b* and the printer driver 20B. The print data generation part 21*b* is a functional part that functions as a print data generating part that generates print data from document data created by application software. In addition, the print data generation part 21*b* generates a control command (print interruption command) that instructs the printer 3 to interrupt the print process being executed and generates a control command (copy count change command) that instructs the printer 3 to change the copy count of the print data and to execute the print process.

The display controller 21*c* is a functional part that controls a display operation of the display part 24. The communication controller 21*d* is a functional part that controls transmission and reception of the data (including commands) to and from an external device (here, printer 3) by the communication part 26.

Next, a configuration of the image forming device 3 is explained. The printer as the image forming device includes a controller 31, a memory part 32, an input part, a display part 34, a print part 35 and a communication part 36.

The controller 31 is a component that controls the operation of the printer 3 and is realized as a CPU executes a control program stored in a ROM and the like. The memory part 32 is a component that stores various data and programs and is configured from a RAM, ROM, flash memory and the like.

The input part 33 is a component by which the user inputs various data and the like and is configured from operation keys. The display part 34 is a component that displays various images and is configured from a display, such as an LCD and the like.

The print part 35 is a component that executes the print process. The communication part 36 is a component that transmits and receives various data and is configured from an input/output port. The communication part 36 receives various data and commands (e.g., print data, print interruption command, copy count change command) from the PC 2 through the LAN 6. The various data and commands received are stored in the memory part 32.

The controller 31 functions as a main controller 31*a*, an analysis part 31*b*, an edit and development part 31*c*, a print controller 31*d*, a notification part 31*e* and a communication controller 31*f*.

The main controller 31*a* is a functional part that controls operation of each part. The main controller 31*a* controls, for example, transmission and reception processes for various data and commands executed by the communication part 36, an analysis process executed by the analysis part 31*b*, an edit process and a development (rasterizing) process executed by the edit and development part 31*c*, and a scheduling process executed by the print controller 31*d*. The "scheduling process" means a process to adjust an order of the print processes to be executed.

The analysis part 31*b* analyzes the data and commands (specifically, print data, print interruption command, copy count change command, etc.) transmitted from the PC 2, received by the communication part 36, and stored in the memory part 32.

The edit and development part 31*c* edits and develops (rasterizes) the print data and generate raster data in which image contents are dot-patterned.

The print controller 31*d* schedules the print order of the raster data generated by the edit and development part 31*c*, outputs the raster data in the order to the print part 35, and causes the print part 35 to execute the print processes.

The notification part 31*e* notifies the PC 2, as a result information, whether or not a setting content of the copy count change command received by the communication part 36 is reflected in the print data.

<Operations of Data Processing Device and Image Forming Device>

Figure 2A:
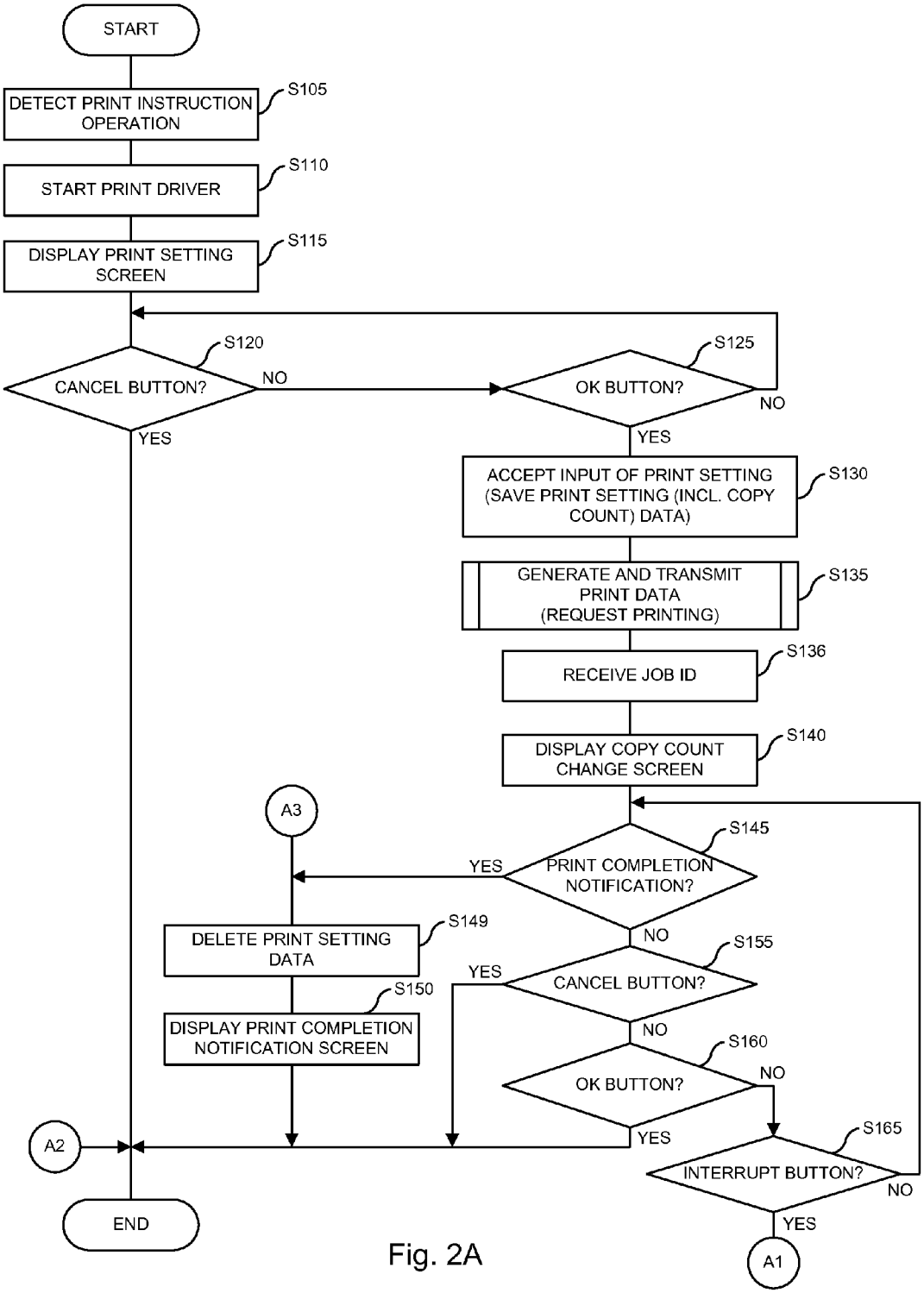
FIG. 2A is a first flow diagram illustrating an entire operation of the data processing device according to the first embodiment.
Figure 2B:
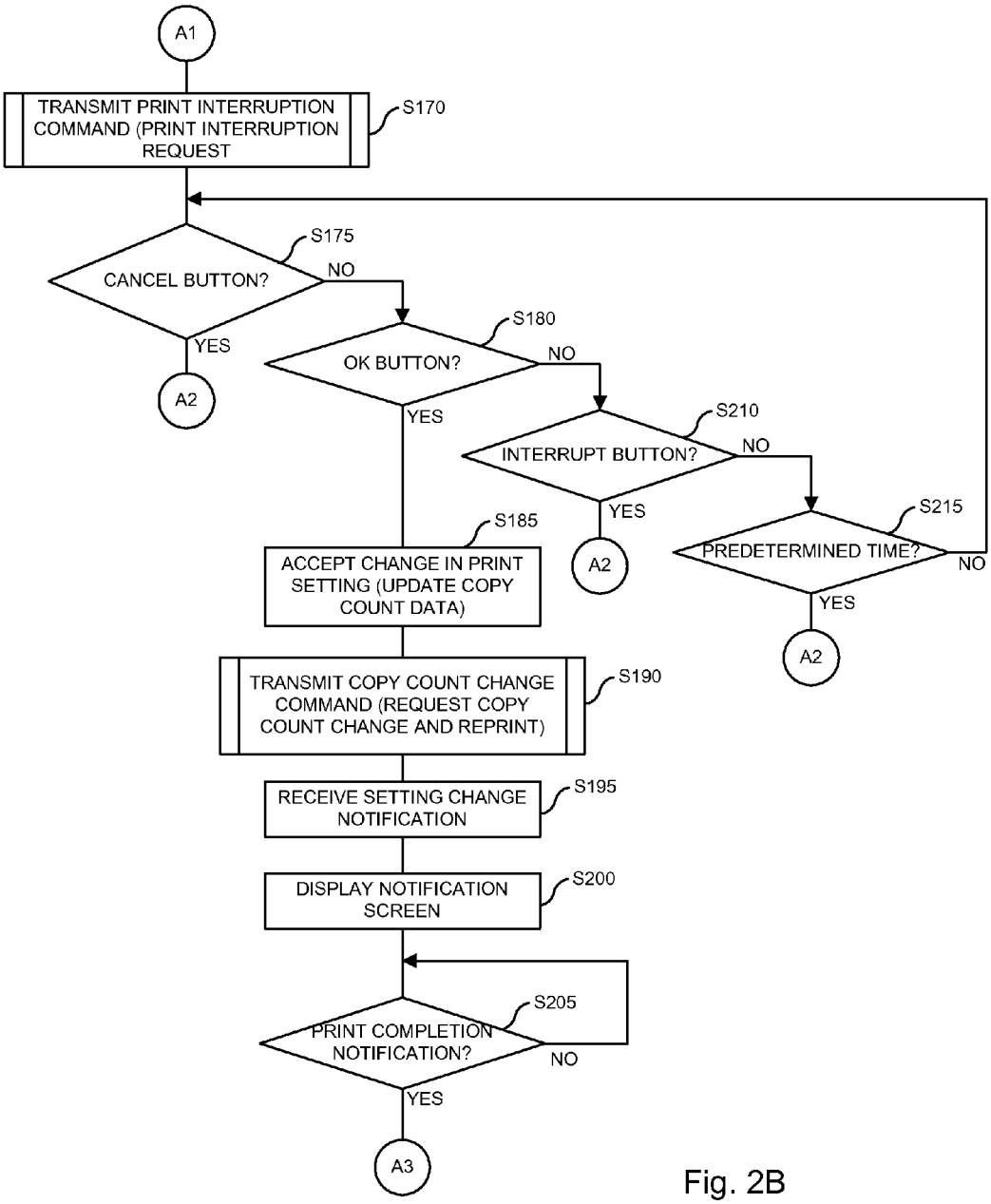
FIG. 2B is a second flow diagram illustrating the entire operation of the data processing device according to the first embodiment.
Figure 6:
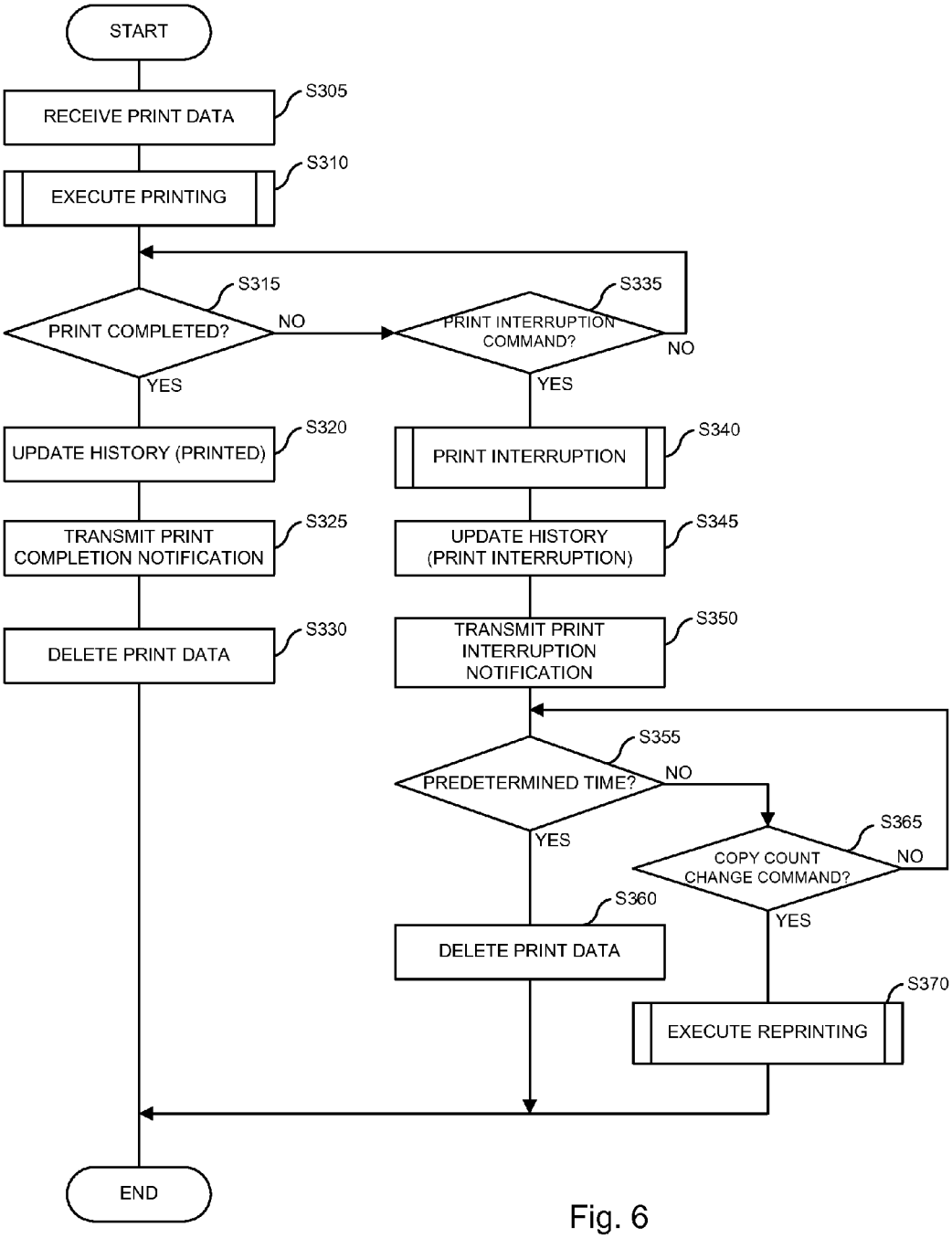
FIG. 6 is a flow diagram illustrating an entire operation of the image forming device according to the first embodiment.

Operations of the data processing device according to the first embodiment are explained below with reference to FIGS. 2A and 2B. In addition, operations of the image forming device are explained with reference to FIG. 6. FIGS. 2A and 2B are flow diagrams illustrating an entire operation of the data processing device according to the first embodiment. FIG. 6 is a flow diagram illustrating an entire operation of the image forming device according to the first embodiment.

The operation at each device is regulated by the programs readably stored in advance in the memory part of each device and is realized by the controller of each device. In addition, the communication between devices is performed as the receiving side device once stores the data received by the communication in the memory part and thereafter reads the data from the memory part. In addition, each data is outputted to the component that is required for performing the subsequent processes after being once readably stored in the memory part. Because these points are usual practices in information processing, detailed descriptions are omitted below.

(Operation of Data Processing Device)

First, the operation of the PC 2 as the data processing device 2 is explained. The PC 2 starts the series of processes as the user operates the PC 2 to instruct the printing of document data created by the application software.

First, as shown in FIGS. 2A and 2B, when the user operates a keyboard 23 to instruct the printing of the document data, the OS 20A detects the operation (S105) and starts the printer driver 20B in response to the detection (S110).

Figure 11:
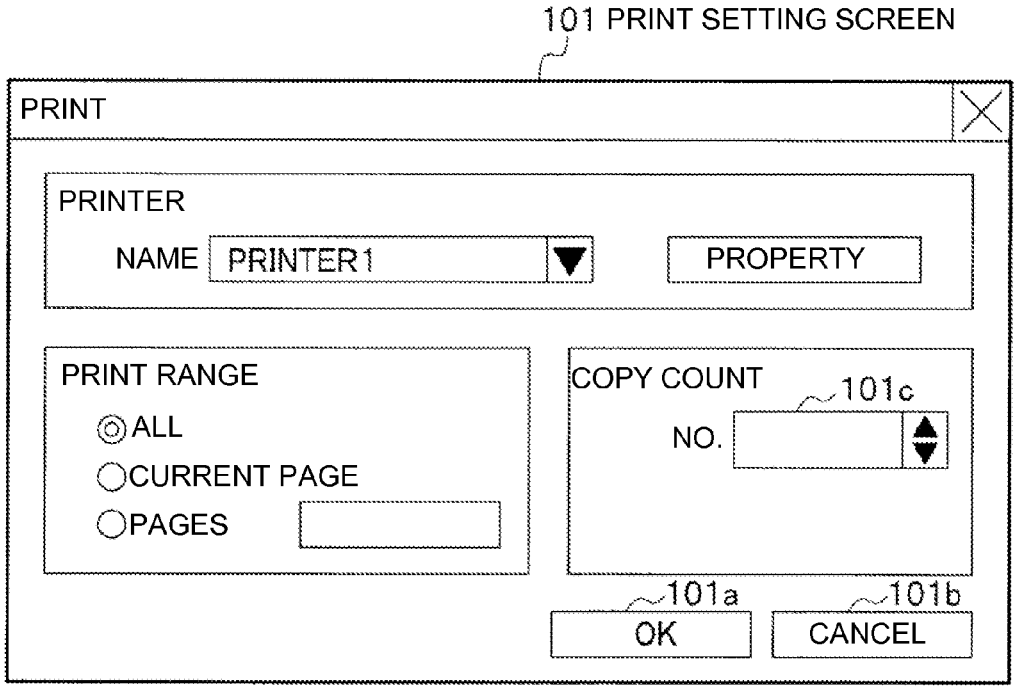
FIG. 11 is a first diagram illustrating an example of a display screen of the data processing device according to the first embodiment.

When the printer driver 20B is started, the main controller 21*a* of the printer driver 20B displays on the display part 24 a print setting screen 101 shown in FIG. 11, for example. In particular, the main controller 21*a* outputs a request for displaying the print setting screen 101 (display request) to the display controller 21*c*. When the display request is inputted from the main controller 21*a*, the display controller 21*c* reads out image data for displaying the print setting screen 101 from the memory part 22 and outputs the image data to the display part 24, causing the print setting screen 101 to be displayed on the display part 24. The operations of the main controller 21*a* and the display controller 21*c* for displaying various screens on the display part 24 are the same as the above-description. Therefore, the explanation is omitted below.

FIG. 11 is a diagram illustrating an example of a display screen of the data processing device according to the first embodiment and illustrates a configuration example of the print setting screen 101. The "print setting screen 101" is a dialogue box for instructing the printing of document data. In the example shown in FIG. 11, the print setting screen 101 includes an OK button 101*a*, a cancel button 101*b*, a copy count input area 101*c* for inputting a desired copy count, and the like. In the print setting screen 101, desired print setting may be inputted in each of print setting items, such as printer names and print ranges.

When the user does not instruct the printing and ends the process as is, the user presses the cancel button 101*b*. On the other hand, when the user instructs the printer 3 to print, the user appropriately inputs the desired print setting in each print setting item and presses the OK button 101*a*. Here, the explanation is made with an assumption that the user inputs the desired copy count (e.g., "10") in the copy count input area 101*c* in the print setting screen 101 and presses the OK button 101*a*.

When the print setting screen 101 is displayed on the display part 24, the main controller 21*a* of the PC 2 determines whether or not the cancel button 101*b* has been pressed by the user (S120). If the determination in S120 indicates that the cancel button 101*b* has been press ("Yes"), the main controller 21*a* ends the series of processes. In contrast, if the determination indicates that the cancel button 101*b* has not been press ("No"), the main controller 21*a* determines as to whether or not the OK button 101*a* has been press by the user (S125).

If the determination in S125 indicates that the OK button 101*a* has been press ("Yes"), the main controller 21*a* accepts the print setting inputted in each print setting item in the print setting screen 101 (S130). At this time, the main controller 21*a* saves in the memory part 22 values of the print settings inputted in the respective print setting items in the print setting screen 101 (in particular, the copy count inputted in the copy count input area 101*c* shown in FIG. 11) as the print setting data. Below, the data that represents the value for the copy count is referred to as "copy count data." In the memory part 22, print setting data, such as computer names, IP addresses, port names and the like, are saved in advance. The print setting data that includes the copy count data is used for generating the print data, print interruption command, copy count change command and the like. In the meantime, if the determination in S125 indicates that the OK button 101*a* has not been pressed ("No"), the main controller 21*a* repeats the processes at S120 and S125.

Figure 3:
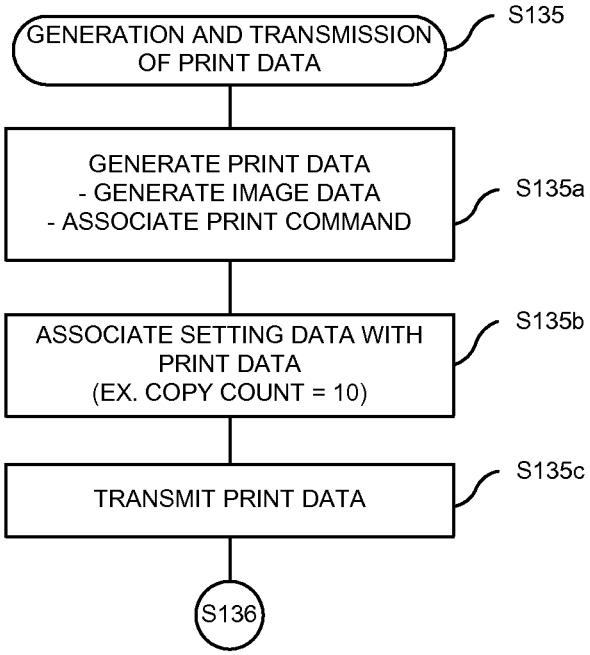
FIG. 3 is a flow diagram illustrating an operation of the data processing device according to the first embodiment at the time of generating and transmitting print data.

After S130, the main controller 21*a* causes the print data generation part 21*b* and the communication controller 21*d* to execute a "print data generation and transmission" process and requests the printer 3 to print (S135). The printer 3 starts the print process by receiving the print data from the PC 2 in S305 shown in FIG. 6. Details of S135 are shown in FIG. 3. FIG. 3 is a flow diagram illustrating the operation of the data processing device according to the first embodiment at the time of generating and transmitting the print data.

As shown in FIG. 3, the main controller 21*a* first causes the print data generation part 21*b* to generate the print data (S135*a*). More specifically, the main controller 21*a* outputs a print data generation request to the print data generation part 21*b*. When the print data generation request is inputted from the main controller 21*a*, the print data generation part 21*b* generates image data used for the print process from document data and associates a print command with the image data to generate the print data. The "print command" is a control command for instructing the printer 3 to print an image represented by the image data included in the print data.

When the print data is generated, the main controller 21*a* reads out the print setting data (e.g., copy count, computer name, IP address, port name and the like) from the memory part 22 and changes a job type as "print." The main controller 21*a* also causes the print data generation part 21*b* to associate the print setting data with the print data (S135*b*). In particular, the main controller 21*a* outputs a request for associating the print setting data with the print data to the print data generation part 21*b*. When the request for associating the print setting data with the print data is inputted from the main controller 21*a*, the print data generation part 21*b* associates print data association setting data 201 shown in FIG. 16, for example, with the print data. Here, the explanation is made with an assumption that the print data generation part 21*b* associates setting data 201 in which the copy count is "10," with the print data. Below, the print data with which the setting data 201 has been associated is also referred to simply as "print data." For example, the print data generation part 21*b*, which is the print data generator, generates several different page image data (in this example, page image data composed of ten different pages) from the document data as the image data used for the print process according to instructions of the main controller 21*a*. Further, according to instructions of the main controller 21*a*, the print data generation part 21*b* adds setting data, which designate the copy count to be 10 copies, to the print data so that the print data generation part 21*b* generates the print data of total 100 pages by which 10 copies for each of the ten pages are made.

FIG. 16 is a diagram illustrating a configuration example of the setting data used in the first embodiment. FIG. 16 indicates, as the setting data 201, setting items, such as job type, copy count, computer name, IP address, port name and the like, and values corresponding to the respective setting items.

After S135*b*, the main controller 21*a* causes the communication controller 21*d* to transmit the print data to the printer 3 (S135*c*). At this time, the communication controller 21*d* transmits the print data from the communication part 26 to the printer 3 through the LAN 6. When the print data is received from the PC 2, the printer 3 assigns a job ID to the print data and notifies the PC 2 of the job ID. Thereafter, the process moves to S136 shown in FIG. 2A.

As shown in FIG. 2A, after S135 (strictly speaking, S135*c*), the main controller 21*a* of the PC 2 receives the job ID from the printer 3 (S136). Then, the main controller 21*a* stores the job ID in the memory part 22 by associating the job ID with the print setting data including copy count data that is stored in the memory part 22 in S130. The job ID stored in the memory part 22 is used for generating setting data 202 and 203 (see FIGS. 17 and 18) that are associated with the print interruption command at the time of transmitting the print interruption command to the printer 3 in S170 shown in FIG. 2B or associated with the copy count change command at the time of transmitting the copy count change command to the printer 3 in S190 shown in FIG. 2B. Here, the explanation is made with an assumption that the job ID used as an ID that is generated by the printer 3. However, the PC 2 may generate the ID and use such ID.

Figure 12:
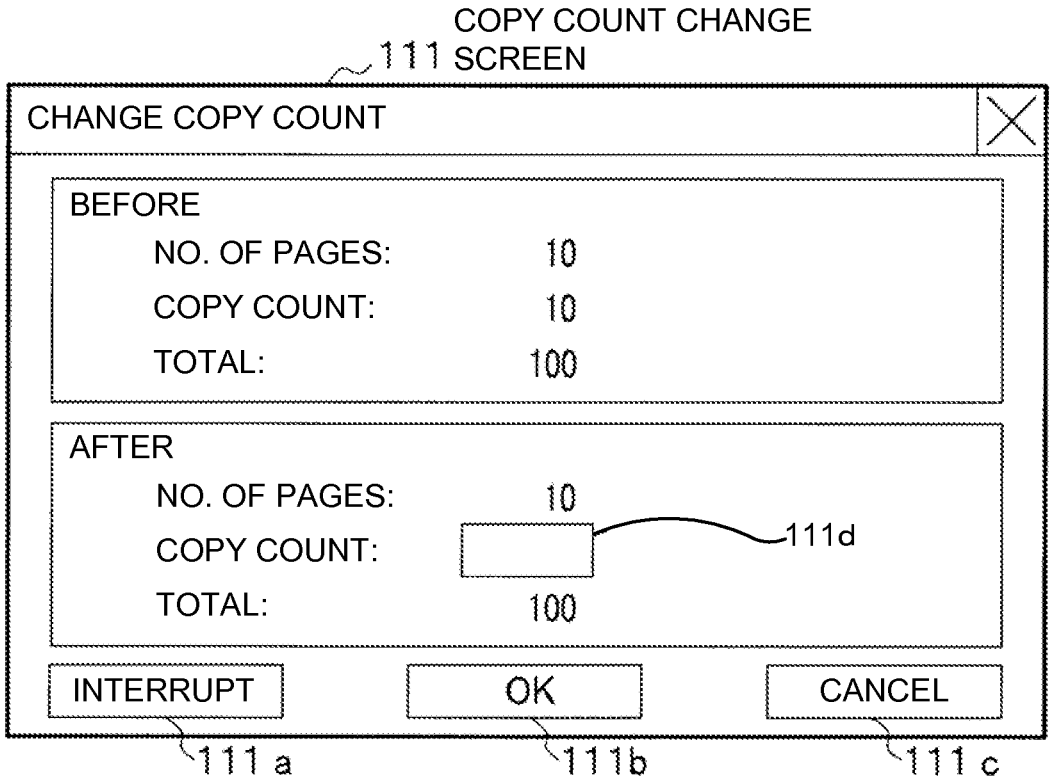
FIG. 12 is a second diagram illustrating an example of the display screen of the data processing device according to the first embodiment.

After that, the main controller 21*a* displays on the display part 24 a copy count change screen 111 shown in FIG. 12, for example (S140). FIG. 12 is a diagram illustrating an example of a display screen of the data processing device according to the first embodiment and illustrates a configuration example of the copy count change screen 111. The "copy count change screen 111" is a dialogue box for instructing a change in the copy count. The copy count change screen 111 is preferably configured such that the copy count change screen 111 may be stored and displayed as being reduced in a part of an edge of the display part 24 (e.g., a side bar) by performing a predetermined operation. In the example shown in FIG. 12, the copy count change screen 101 includes an interrupt button 111*a*, an OK button 111*b*, a cancel button 111*c*, a copy count input area 111*d* for inputting a desired copy count, and the like. The explanation is made with an assumption that a value cannot be inputted in the copy count input area 111*d* immediately after S140 and that the value can be inputted when a print interruption command is transmitted to the printer 3 in S170 ("print interruption command transmission (print interruption request" process) shown in FIG. 2B.

The copy count change screen 111 is capable of instructing an interruption of print process, a change in the copy count, a cancellation of print instructions (job cancellation) for the print data (preferably, the most recent print data) transmitted to the printer 3. The copy count change screen 111 is continuously displayed while the print process is executed by the printer 3 and automatically closes (disappears) when the printing is completed. The copy count change screen 111 also closes when the cancel button 111*c* is pressed. The copy count change screen 111 is preferably configured to show a comparison of the settings before and after the change as shown in FIG. 12.

When the copy count change screen 111 is displayed on the display part 24 in S140, the user presses the cancel button 111*c* or the OK button 111*b* when the print process is to be executed by the printer 3 without changing the copy count. On the other hand, when the user changes the copy count, the user presses the interruption button 111*a* shown in FIG. 12 to interrupt the print process being executed by the printer. The printer 3 starts the print process when the print data transmitted from the PC 2 in S135 is received, and transmits a print completion notification to the PC 2 when the print process is completed.

Then, when the copy count change screen 111 is displayed on the display part 24, the main controller 21*a* first determines whether or not the print completion notification has been received from the printer 3 (S145). If the determination in S145 indicates that the print completion notification has been received ("Yes"), the main controller 21*a* deletes the copy count data saved in the memory part 22 in S130 (S149), displays on the display part 24*a* notification screen (not shown) indicating the completion of the printing (preferably for a predetermined time) (S150), and ends the series of processes. If the print completion notification has not been received ("No"), the main controller 21*a* determines whether or not the cancel button 111*c* has been pressed by the user (S155).

If the determination in S155 indicates that the cancel button 111*c* has been pressed ("Yes"), the series of processes end. On the other hand, if the determination indicates that the cancel button 111*c* has not been pressed ("No"), the main controller 21*a* determines whether or not the OK button 111*b* has been pressed by the user (S160).

If the determination in S160 indicates that the OK button 111*b* has been pressed ("Yes"), the series of processes end. In contrast, if a determination indicates that the OK button 111*b* has not been pressed ("No"), the main controller 21*a* determines whether or not the cancel button 111*a* has been pressed by the user (S165).

If the determination in S165 indicates that the cancel button 111*a* has been pressed ("Yes"), the process moves to S170 shown in FIG. 2B via "A1." In contrast, if the determination in S125 indicates that the cancel button 111*a* has not been pressed ("No"), the main controller 21*a* repeats the determination processes in S155, S160 and S165.

Figure 4:
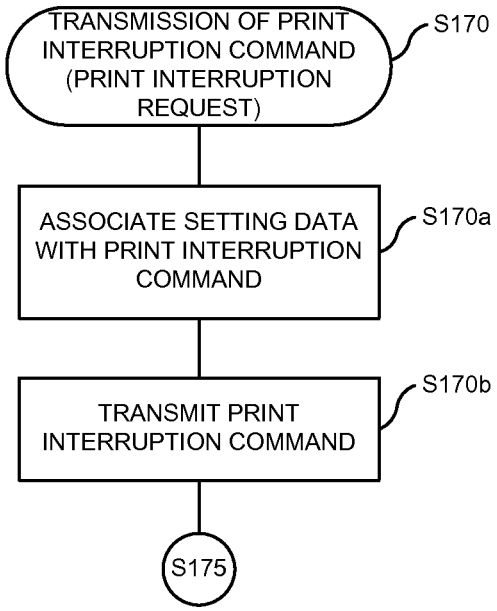
FIG. 4 is a flow diagram illustrating an operation of the data processing device according to the first embodiment at the time of transmitting a print interruption command.

If the determination in S165 indicates that the cancel button 111*a* has been pressed ("Yes"), the main controller 21*a* causes the print data generation part 21*b* to perform the "print interruption command transmission" process to request the printer 3 to interrupt the print process (S170). Details of S170 are shown in FIG. 4. FIG. 4 is a flow diagram illustrating the operation of the data processing device according to the first embodiment at the time of transmitting the print interruption command. When the "print interruption command transmission" process is executed in S170, the main controller 21*a* changes a screen setting of the copy count change screen 111 displayed on the display part 24 such that a value can be inputted in the copy count input area 111*d*.

As shown in FIG. 4, the main controller 21*a* causes the print data generation part 21*b* to associate setting data with the print interruption command (S170*a*). More specifically, the main controller 21*a* outputs a print interruption request to the print data generation part 21*b*. When the print interruption request is inputted from the main controller 21*a*, the print data generation part 21*b* associates print interruption command association setting data 202 shown in FIG. 17, for example, with the print data. Below, the print interruption command with the setting data 202 is referred to simply as "print data."

FIG. 17 is a diagram illustrating a configuration example of setting data used in the first embodiment. FIG. 17 indicates, as the setting data 202, setting items, such as job type, job ID, computer name, IP address, port name and the like, and values corresponding to the respective setting items.

After S170*a*, the main controller 21*a* causes the communication controller 21*d* to transmit the print interruption command to the printer 3 (S170*b*). Thereafter, the process moves to S175 shown in FIG. 2B.

Figure 13A:
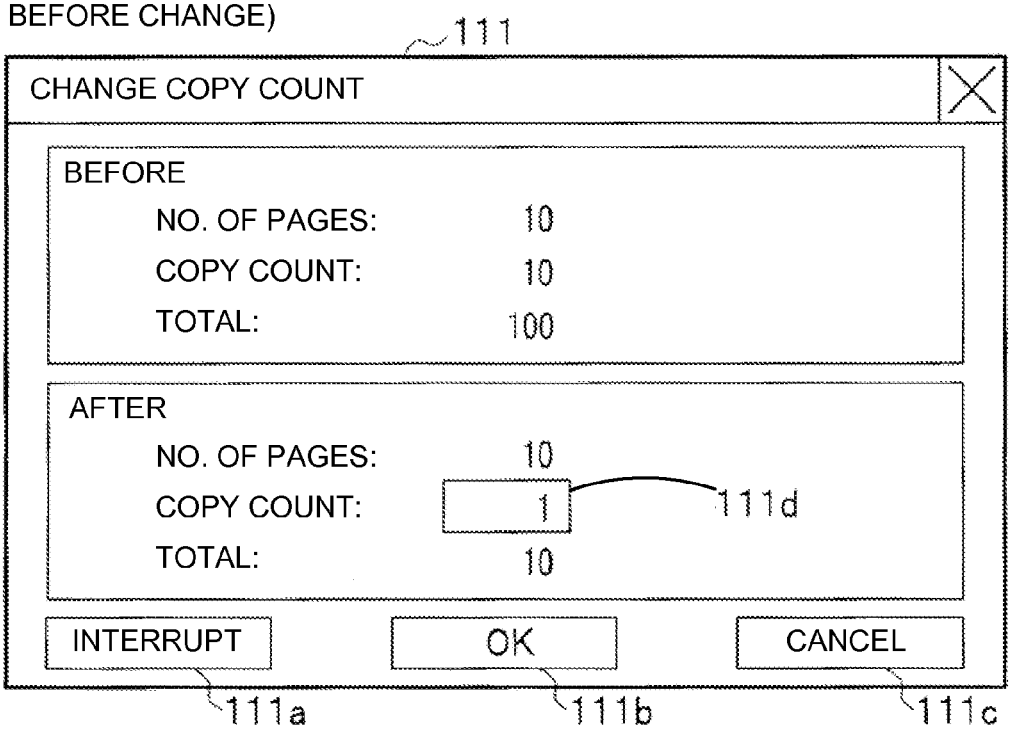
FIGS. 13A to 13C are third diagrams illustrating examples of the display screen of the data processing device according to the first embodiment.

After that, if the user makes the printer 3 stands by while the print processes are being interrupted (if the user causes the PC 2 to close the copy count change screen 111), the user presses the cancel button 111*c* or the interruption button 111*a* shown in FIG. 13A. Alternatively, when the user changes the copy count, the user inputs a desired copy count in the copy count input area shown in FIG. 13A, and presses the OK button 111*b*. Yet alternatively, when the user instructs the printer to cancel the print instruction (job cancellation), the user inputs "0" in the copy count input area 111*d* shown in FIG. 13A and presses the OK button 111*b*.

Then, as shown in FIG. 2B, after S170 (strictly speaking, S170*b*), when the print interruption command is transmitted to the printer 3, the main controller 21*a* determines whether or not the cancel button 111*c* has been pressed by the user. If the determination in S175 indicates that the cancel button 111*c* has been pressed ("Yes"), the main controller ends the series of processes. On the other hand, if the determination indicates that the cancel button 111*c* has not been pressed ("No"), the main controller 21*a* determines whether or not the OK button 111*b* has been pressed by the user (S180).

If the determination in S180 indicates that the OK button 111*b* has been pressed ("Yes"), the main controller 21*a* accepts a change in the print setting inputted in each print setting item in the print setting screen 101 (S185). At this time, the main controller 21*a* updates the copy count data saved in the memory part 22 to the copy count data inputted to the copy count input area 111*d* in the copy count change screen 111. That is, the main controller 21*a* overwrites the copy count data inputted to the copy count input area 111*d* in the copy count change screen 111 on the copy count data saved in the memory part 22 in S130. Here, the explanation is made with an assumption that the value "10" of the copy count data in the print setting accepted in S130 shown in FIG. 2A is changed to a value "1."

Figure 5:
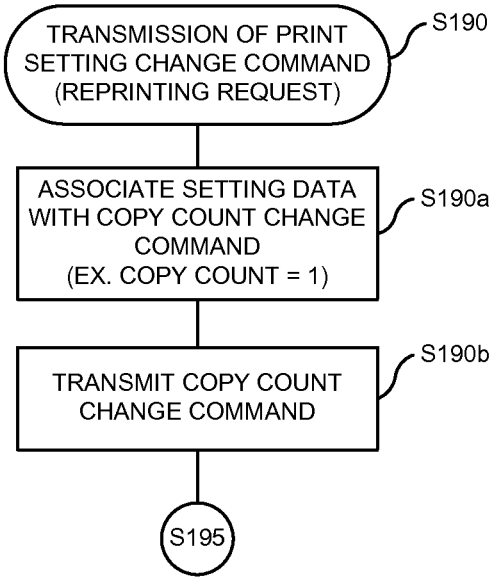
FIG. 5 is a flow diagram illustrating an operation of the data processing device according to the first embodiment at the time of transmitting a copy count changing command.

When the main controller 21*a* accepts the change in the print settings that are inputted in the respective print setting items in the copy count change screen 111, the main controller 21*a* causes the print data generation part 21*b* to execute the "copy count change command transmission" process to request the printer 3 to change the copy count and to execute the reprinting (S190). Details of S190 are shown in FIG. 5. FIG. 5 is a flow diagram illustrating an operation of the data processing device according to the first embodiment at the time of transmitting a copy count changing command.

As shown in FIG. 5, the main controller 21*a* causes the print data generation part 21*b* to associate setting data with the copy count change command (S190*a*). More specifically, the main controller 21*a* outputs a copy count change request to the print data generation part 21*b*. When the copy count change request is inputted from the main controller 21*a*, the print data generation part 21*b* associates copy count change command association setting data 203 shown in FIG. 18, for example, with the copy count change command. Below, the copy count change command with the setting data 203 is referred to simply as "copy count change command." The copy count change command may be replaced by data with a configuration similar to the print data (more specifically, a so-called re-print data in which a control command that instructs the change in the copy count and the resuming (reprinting) of the print process is associated with the image data generated from document data).

FIG. 18 is a diagram illustrating a configuration example of the setting data used in the first embodiment. FIG. 18 indicates, as the setting data 203, setting items, such as job type, job ID, copy count, computer name, IP address, port name and the like, and values corresponding to the respective setting items. Here, in the setting data 203, the value of the copy count data is set to "1" to change the copy count by which the printer 3 performs the print process from "10" to "1."

After S190*a*, the main controller 21*a* causes the communication controller 21*d* to transmit the copy count change command to the printer 3 (S190*b*). Thereafter, the process moves to S195 shown in FIG. 2B.

Here, when the printer 3 receives the copy count change command transmitted from the PC 2 in S190, the printer 3 changes the copy count, transmits to the PC 2 a setting change notification that indicates that the copy count has been changed, and resumes the print process (executes the reprinting). Then, when the print process is completed, the printer 3 transmits a print completion notification to the PC 2.

Therefore, as shown in FIG. 2B, after S190, the main controller 21*a* receives the setting change notification from the printer 3. When the main controller 21*a* receives the setting change notification from the printer 3, the main controller 21*a* displays on the display part 24*a* notification screen (e.g., notification screen 115 shown in FIG. 15B) indicating that the copy count has been changed (S200) and determines whether or not a print completion notification has been received from the printer 3 (S205).

If the determination in S205 indicates that the print completion notification has been received ("Yes"), the process moves to S149 ("copy count data deletion" process) shown in FIG. 2A via "A3." In this case, the main controller 21*a* ends the series of processes after executing the "print completion display" process in S150. On the other hand, if the determination in S205 indicates that the print completion notification has not been received ("No"), the main controller 21*a* repeats the determination process in S205.

If a determination in S180 indicates that the OK button 111*b* has not been press ("No"), the main controller 21*a* determines whether or not the cancel button 111*a* has been pressed by the user (S210).

If the determination in S210 indicates that the interrupt button 111*a* has been pressed ("Yes"), the main controller 21*a* ends the series of processes. On the other hand, if the determination in S210 indicates that the interrupt button 111*a* has not been pressed ("No"), the main controller determines whether or not a predetermined time has elapsed since the transmission of the print interruption command in S170 (S215).

If the determination in S215 indicates that the predetermined time has elapsed ("Yes"), the main controller 21*a* ends the series of processes. In contrast, if the determination in S125 indicates that the predetermined time has not elapsed ("No"), the main controller 21*a* repeats the determination processes in S175, S180, S210 and S215.

(Operation of Image Forming Device)

Next, the operation of the printer 3 as the image forming device is explained. When the printer 3 receives the print data from the PC 2, the printer 3 stars the print process after storing the print data in the memory device 32. Then, if the printer 3 receives the print interruption command from the PC 2, the printer 3 interrupts the print process and stores history data at the time of interruption in the memory part 32. After that, if the printer 3 receives the copy count change command from the PC 2, the printer specifies a unprocessed copy count based on the number of printed copies indicated by the history data at the time of the interruption and the copy count after the change designated by the copy count change command, and executes the print process for the unprocessed copy count.

The operation of the printer 3 changes depending on the relationships between the following three types of the copy count: (1) the copy count before the change designated by the print data (strictly speaking, the copy count data attached to the print data as the setting data) stored in the memory part 32; (2) the copy count that has already been printed as indicated by the history data at the time of interruption; and (3) the copy count after the change designated by the copy count change command. The PC 2 changes the screen patterns displayed on the display part 24 as shown in FIGS. 13A to 15B, for example, in response to the change in the operation of the printer 3. The change in the screen patterns is explained in the section of "Examples of display screen of data processing device."

Here, the explanation is made with an assumption that the PC 2 executes the "print data generation and transmission (print request)" process in S135 shown in FIG. 2A and that the printer 3 starts the series of processes by receiving the print data transmitted from the PC 2 in the process in S135.

Figure 7:
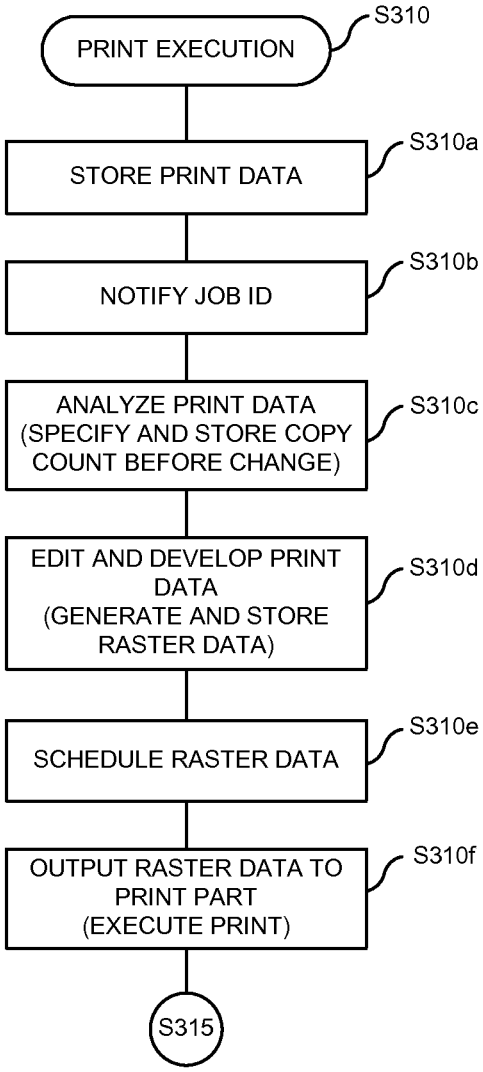
FIG. 7 is a flow diagram illustrating an operation of the image forming device according to the first embodiment at the time of executing the printing.

First, as shown in FIG. 6, when the printer 3 receives the print data from the PC 2 by the communication part 36, the main controller 31*a* causes the print controller 31*d* to execute the print process (S310). Details of S310 are shown in FIG. 7. FIG. 7 is a flow diagram illustrating the operation of the image forming device according to the first embodiment at the time of executing the printing.

As shown in FIG. 7, in the printer 3, the main controller 31 (or the communication controller 31*f*) assigns (sets) an job ID to the print data received from the PC 2 and stores the print data in the memory part 32 (S310*a*). Then, the main controller 31*a* causes the communication controller 31*f* to notify (transmit to) the PC 2 the job ID assigned to the print data.

Next, the main controller 31*a* causes the analysis part 31*b* to analyze the print data and to specify the copy count (S310*c*). More specifically, the main controller 31*a* outputs a print data analysis request stored in the memory part 32 to the analysis part 31*b*. When the analysis part 31*b* receives an input of the analysis request from the main controller 31*a*, the analysis part 31*b* reads out the print data from the memory part 32 and analyses the read-out print data. Then, the analysis part 31*b* specifies the copy count to be printed and the like based on the copy count data associated with the print data as setting data and outputs the copy count and the like as the analysis result to the main controller 31*a*. Here, a value "10" is assumed to be designated as the value for the copy count in the copy count data associated with the print data. Therefore, the analysis part 31*b* outputs to the main controller 31*a* "10," which is the value of the copy count, as the analysis result. Below, the copy count designated by the copy count data associated with the print data is referred to as a "copy count before change." When the value of the copy count before change is inputted as the analysis result from the analysis part 31*b*, the main controller 31*a* stores the value of the copy count before change in the memory part 32. In addition, the main controller 31*a* stores in the memory part 32 the value of the copy count before change as the value of the copy count to be printed.

When the analysis result is inputted form the analysis part 31*b*, the main controller 31*a* causes the edit and development part 31*c* to execute the editing process and development process for the print data (S310*d*). More specifically, the main controller 31*a* outputs a print data editing and development request to the edit and development part 31*c*. At this time, the main controller 31*a* requests the edit and development part 31*c* to repeats the editing process and development process for the print data by the copy count (i.e., 10) set to the print data. When the print data editing and development request is inputted, the edit and development part 31*c* edits (executes a process to convert image contents into an intermediate language) and develops (executes a process to convert the image contents converted into the intermediate language into dot patterns) of the print data, generates raster data and store the generated raster data in the memory part 32.

When the raster data is stored in the memory part 32, the main controller 31*a* causes the print controller 31*d* to schedule the raster data (to execute a process to adjust the execution order of the print processes) (S310*e*). Then, the main controller 31*a* causes the print controller 31*d* to output the raster data to the print part 35 (S310*f*). As a result, the print part 35 executes a print process based on the raster data. After this, the process moves to S315 shown in FIG. 6.

As shown in FIG. 6, after S310 (strictly speaking, S310*f*), the main controller 31*a* determines whether or not the print process has completed (S315). If the determination in S315 indicates that the print process has completed ("Yes"), the main controller 31*a* updates the printed history data (not shown) stored in a predetermined memory region in the memory part 32 (S320). The "printed history data" indicates data that represents history of the print data for which the print process has been executed.

After the main controller 31*a* updates the printed history data, the main controller 31*a* causes the notification part 31*e* and the communication controller 31*f* to transmit a print complication notification to the PC 2 (S325). More specifically, the main controller 31*a* outputs a print completion notification transmission request to the notification part 31*e* and the communication controller 31*f*. In response to the transmission request, the notification part 31*e* generates a message data as the print completion notification indicating that the print has completed, and the communication part 31*f* transmits the generated message data from the communication part 36 to the PC 2 through the LAN 6.

After S325, the main controller 31*a* deletes the print data for which the print process has been executed, from the memory part 32 (S330) and ends the series of processes.

If the determination in S315 indicates that the print process has not been completed ("No"), the main controller 31*a* determines whether or not a print interruption command has been received (S335). The determination in S335 indicates "Yes" when the PC 2 transmits a print interruption command in S170 shown in FIG. 2B. If the determination in S335 indicates that the print interruption command has been received ("Yes"), the process moves to S340. On the other hand, if the determination in S335 indicates that the print interruption command has not been received ("No"), the main controller 31*a* repeats the determination processes in S315 and S335.

Figure 8:
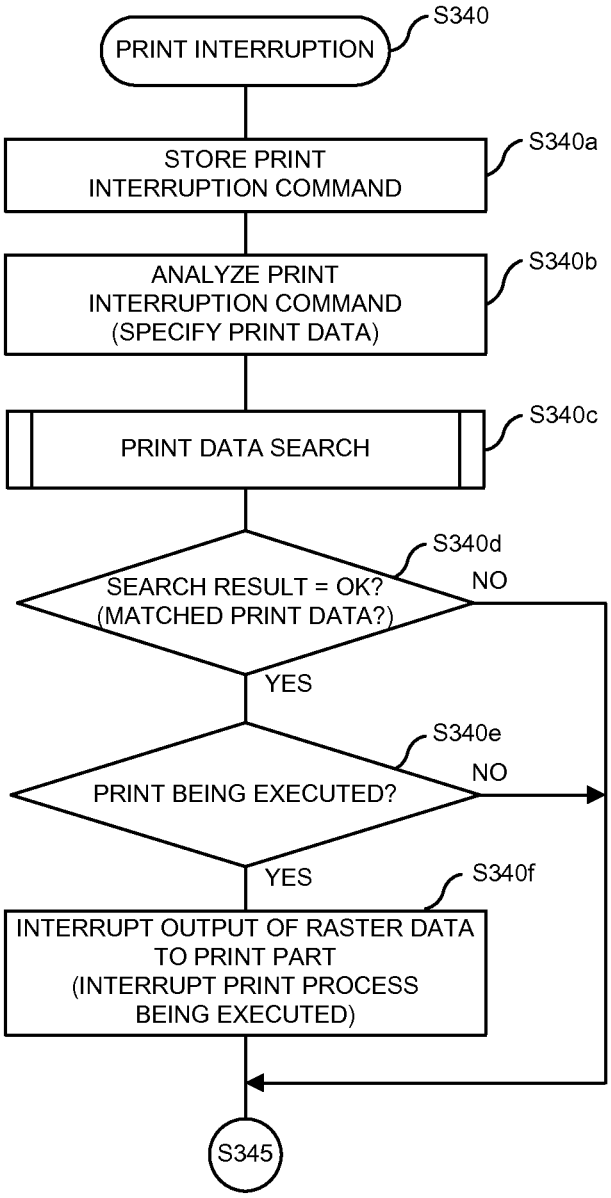
FIG. 8 is a flow diagram illustrating an operation of the image forming device according to the first embodiment at the time of interrupting the printing.

If the determination in S335 indicates that the print interruption command has been received ("Yes"), the main controller 31*a* interrupts the print process being executed by the print controller 31*d* (S340). Details of S340 are shown in FIG. 8. FIG. 8 is a flow diagram illustrating the operation of the image forming device according to the first embodiment at the time of cancelling the printing.

As shown in FIG. 8, in the printer 3, the main controller 31*a* (or the communication controller 31*f*) first stores in the memory part 32 the print interruption command received from the PC 2 (S340*a*). At that time, the main controller 31*a* assigns a job ID to the print interruption command. The job ID assigned to the print interruption command is associated with the job ID assigned to the print data that is determined at the time of analyzing the print interruption command in S340*b*. The data representing the association is stored in the memory part 32.

Next, the main controller 31*a* causes the analysis part 31*b* to analyze the print interruption command and to specify the print data for which the process is to be interrupted (S340*b*). More specifically, the main controller 31*a* outputs to the analysis part 31*b* an analysis request for the print interruption command stored in the memory part 32. When the analysis request is inputted from the main controller 31*a*, the analysis part 31*b* reads out the print interruption command from the memory part 32 and analyzes the read-out print interruption command. Then, the analysis part 31*b* specifies the job ID assigned to the print data for which the process is to be interrupted and outputs the job ID as an analysis result to the main controller 31*a*.

Figure 9:
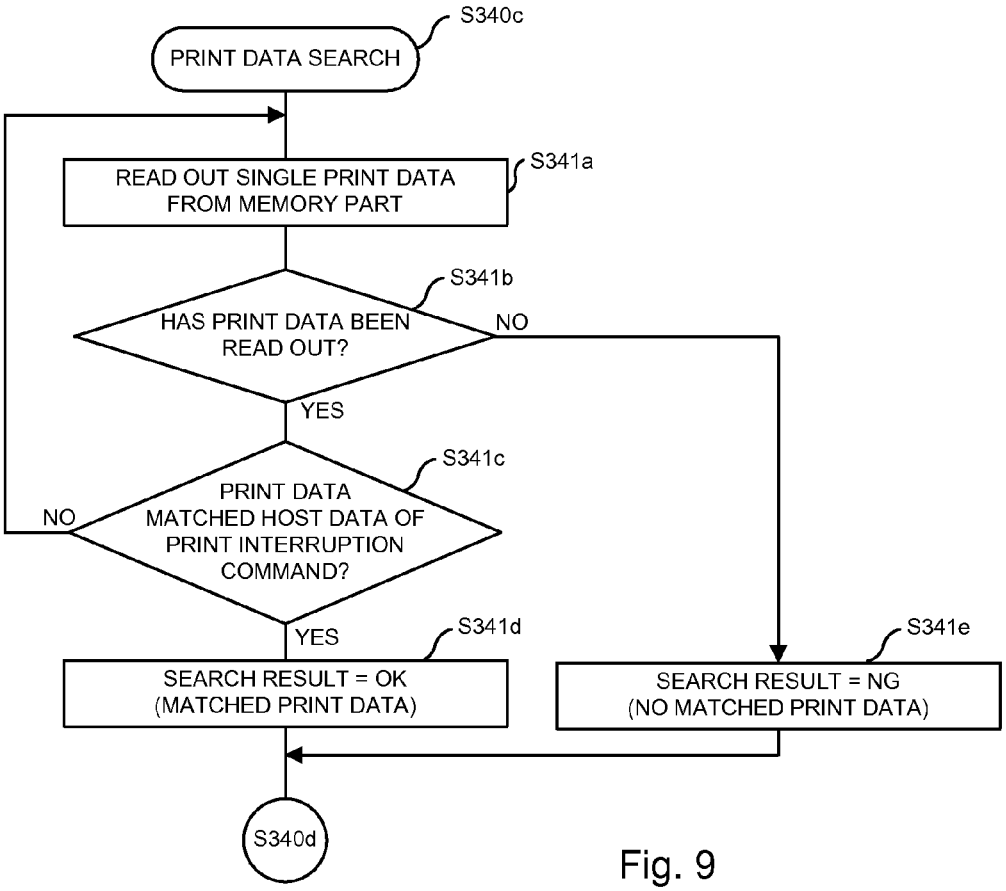
FIG. 9 is a flow diagram illustrating an operation of the image forming device according to the first embodiment at the time of searching the print data.

Next, the main controller 31*a* executes a "print data search" process to search the print data specified by the print interruption command (hereinafter, referred to as "matched print data") in the memory part 32 (S340*c*). Details of S340*c* are shown in FIG. 9. FIG. 9 is a flow diagram illustrating the operation of the image forming device according to the first embodiment at the time of searching the print data.

As shown in FIG. 9, the main controller 31*a* reads out from the memory part 32 single print data stored in the memory part 32 (S341*a*) and determines whether or not the print data has been read out (S341*b*).

If the determination in S341*b* indicates that the print data has been read out ("Yes"), the main controller 31*a* determines whether or not the read-out print data matches host data (job ID (or computer name, IP address, port name, etc.)) of the print data for which the process is to be interrupted that is specified by the print interruption command (S341*c*).

If the determination in S341*c*) indicates that the read-out print data matches the host data ("Yes"), the main controller 31*a* determines that the matched print data is present (exists) in the memory part 32 and recognizes that a search result is OK (S341*d*). After that, the process moves to S340*d* shown in FIG. 8.

On the other hand, if the determination in S341*c* indicates that the read-out print data does not match the host data ("No"), the process returns to S341*a*. As a result, the main controller 31*a* reads out the next print data from the memory part 32 in S341*a* and determines whether the next print data read out in S341*b* matches the host data of the print data for which the process is to be interrupted that is specified by the print interruption command. Then, if the print data that eventually matches the host data does not exist in the memory part 32 (i.e., if the determination is made as "No" in S341*b*), the main controller 31*a* determines that the matched print data is not present (does not exist) in the memory 32 and recognizes that the search result is NG (S341*e*). After this, the process moves to S340*d* shown in FIG. 8.

As shown in FIG. 8, after S340*c* ("print data search" process), the main controller 31*a* determines whether or not the search result is OK (i.e., whether or not the matched print data exists in the memory part 32) (S340*d*).

If the determination in S340*d* indicates that the search result is OK, that is, the matched print data exists in the memory part 32 ("Yes"), the main controller 31*a* determines whether or not the print process for the matched print data is being executed (S340*e*). On the other hand, if the determination in S340*d* indicates that the search result is NG, that is, the matched print data does not exist in the memory part 32 ("No"), the process moves to S345 shown in FIG. 6.

If the determination in S340*e* indicates that the print process for the matched print data is being executed ("Yes"), the main controller 31*a* causes the print controller 31*d* to interrupt the print process being executed (S340*f*). More specifically, the main controller 31*a* outputs a print interruption request to the print controller 31*d*. When the print interruption request is inputted from the main controller 31*a*, the print controller 31*d* interrupts the output of the raster data to the print part 35. As a result, the print part 35 interrupts the print process being executed. After this, the process moves to S345 shown in FIG. 6.

As shown in FIG. 6, after S340, the main controller 31*a* updates the print interruption history data (not shown) that is stored in a predetermined memory region in the memory part 32 (S345). At this time, in the print interruption history data, a value of the copy count that has been executed at the time when the print process (here, referred to as "printed copy count") was interrupted is stored. The "print interruption history data" indicates data that indicates history of print data for which the execution of the print data is interrupted.

When the print interruption history data is updated, the main controller 31*a* causes the notification part 31*e* and the communication controller 31*f* to transmit a print interruption notification to the PC 2 (S350). More specifically, the main controller outputs a print interruption notification transmission request to the notification part 31*e* and the communication controller 31*f*. In response to the transmission request, the notification part 31*e* generates message data as the print interruption notification that indicates that the printing has been interrupted, and the communication controller 31*f* transmits the generated message data from the communication part 36 to the PC 2 through the LAN 6.

After S350, the main controller 31*a* determines whether or not predetermined time has elapsed since the interruption of the print process in S340 (S355). If the determination in S355 indicates that the predetermined time has elapsed ("Yes"), the main controller 31*a* deletes the print data stored in the memory part 32 in S310*a* shown in FIG. 7 (S360) and ends the series of processes. On the other hand, if the predetermined time has not elapsed ("No"), the main controller 31*a* determines whether or not a copy count change command has been received from the PC 2 (S365). The determination in S365 indicates "Yes" when the PC 2 transmits the copy count change command in S190 shown in FIG. 2B.

If the determination in S365 indicates that the copy count change command has been received ("Yes"), the main controller 31*a* causes the print controller 31*d* to execute the reprinting (S370) and ends the series of processes. On the other hand, if the determination in S365 indicates that the copy count change request has not been received ("No"), the main controller 31*a* repeats the determination processes in S355 and S365. Details of S370 are shown in FIGS. 10A to 10D. FIGS. 10A to 10D are flow diagrams illustrating the operations of the data processing device according to the first embodiment at the time of executing the re-printing.

As shown in FIGS. 10A to 10D, in the printer 3, the main controller 31*a* (or communication controller 31*f*) first stores the copy count change command received from the PC 2 in the memory part 32 (S370*a*). At this time, the main controller 31*a* assigns a job ID to the copy count change command. The job ID assigned to the copy count change command is associated with the job ID assigned to the print data that is determined at the time of analyzing the copy count change command in S370*b*. The data representing the association is stored in the memory part 32.

Next, the main controller 31*a* causes the analysis part 31*b* to analyze the print copy count change command and to specify the print data for which the copy count is to be changed (S370*b*). More specifically, the main controller 31*a* outputs to the analysis part 31*b* an analysis request for the copy count change command stored in the memory part 32. When the analysis request is inputted from the main controller 31*a*, the analysis part 31*b* reads out the copy count change command from the memory part 32 and analyzes the read-out copy count change command. Then, the analysis part 31*b* specifies the print data for which the copy count is to be changed, the copy count and the like and outputs, as the analysis result, the print data for which the copy count is to be changed, the copy count and the like to the main controller 31*a*. Below, the copy count designated by the copy count change command is referred to as a "copy count after change." When the value of the copy count after change is inputted as the analysis result from the analysis part 31*b*, the main controller 31*a* stores the value of the copy count after change in the memory part 32.

Next, the main controller 31*a* executes a "print data search" process in the steps similar to the process shown in FIG. 9, to search the print data specified by the copy count change command (hereinafter, referred to as "matched print data") in the memory part 32 (S370*c*).

After S370*c*, the main controller 31*a* determines whether or not the search result is OK (i.e., whether or not the matched print data exists in the memory part 32) (S370*d*). If the determination in S370*d* indicates that the search result is OK, that is, the matched print data exists in the memory part 32 ("Yes"), the process moves to S370*e* shown in FIG. 10B via "B1." On the other hand, if the determination in S370*d* indicates that the search result is not OK, that is, the matched print data does not exist in the memory part 32 ("No"), the main controller 31*a* ends the series of processes.

If the determination in S370*d* indicates that the search result is OK ("Yes"), the main controller 31*a* determines that the copy count after change (i.e., the copy count designated by the copy count change command) is less than the copy count before change (i.e., the copy count designated by the print data" (S370*e*).

If the determination in S370*e* indicates that the copy count after change is less than the copy count before change ("Yes"), the main controller 31*a* determines whether or not the copy count after change is not "0" (copy count after change≠0) (S370*f*). On the other hand, if the determination in S370*e* indicates that the copy count after change is equal to or more than the copy count before change ("No"), the process moves to S370*h* before the determination indicates that there is unprocessed printing.

If the determination in S370*f* indicates that the copy count after change is not "0" ("Yes"), the main controller 31*a* determines whether or not there is unprocessed printing (S370*g*). On the other hand, of the determination in S370*f* indicates that the copy count after change is "0" ("No"), the process moves to S370*q* shown in FIG. 10C via "B3."

If the determination in S370*g* indicates that there is unprocessed printing ("Yes"), the main controller 31*a* updates the value of the copy count to be printed that is stored in the memory part 32 (see S310*c* shown in FIG. 7) from the value of the copy count before change (e.g., 10) to the value of the copy count after change (e.g., 1) (S370*h*). On the other hand, if the determination in S370*g* indicates that there is no unprocessed printing ("No"), the process moves to S370*t* shown in FIG. 10D via "B4."

After S370*h*, the main controller 31*a* calculates a value of the unprocessed copy count from below Equation 1 using the value of the copy count already printed that was stored in the memory part 32 as the history data in S345 shown in FIG. 6 and the value of the copy count to be printed (i.e., copy count after change) that was updated in S370*h* (S370*i*).

$$\text{Unprocessed copy count} = (\text{Copy count after change} - \text{Copy count already printed}) \quad (1)$$

S370*e* to S370*i* configure the "unprocessed copy count specification" process (S371).

After S370*i*, the main controller 31*a* causes the edit and development part 31*c* to execute the editing process and development process for the print data for the unprocessed copy count (S370*j*). More specifically, the main controller 31*a* outputs a print data editing and development request to the edit and development part 31*c*. At this time, the main controller 31*a* requests the edit and development part 31*c* to repeats the editing process and development process for the print data for the unprocessed copy count. When the print data editing and development request is inputted, the edit and development part 31*c* edits and develops of the print data, generates raster data and store the generated raster data in the memory part 32.

When the raster data is stored in the memory part 32, the main controller 31*a* causes the print controller 31*d* to schedule the raster data (to execute a process to adjust the execution order of the print processes) (S370*k*). Then, the main controller 31*a* causes the print controller 31*d* to output the raster data to the print part 35 (S370*l*). As a result, the print part 35 resumes a print process (executes re-printing) based on the raster data.

When the print process is resumed, the main controller 31*a* causes the notification part 31*e* and the communication controller 31*f* to transmit the setting change notification to the PC 2 to notify the PC 2 that the setting content designated by the copy count change command (e.g., copy count="1") has been reflected to the print data (S370*m*). More specifically, the main controller outputs a setting change notification transmission request to the notification part 31*e* and the communication controller 31*f*. In response to the transmission request, the notification part 31*e* generates message data as the setting change notification that indicates that the copy count has been changed and that the print process is to be resumed (e.g., "Copy count has been changed. Printing will be resumed."), and the communication controller 31*f* transmits the generated message data from the communication part 36 to the PC 2 through the LAN 6. In response, the PC 2 displays the notification screen 112 shown in FIG. 13B, for example, on the display part 24.

After S370*m*, the main controller 31*a* updates the printed history data (not shown) stored in a predetermined memory region in the memory part 32 so that printed history data indicates that the print process was resumed (reprinted) (S370*n*). Similar to S325 shown in FIG. 6, after the main controller 31*a* updates the printed history data, the main controller 31*a* causes the notification part 31*e* and the communication controller 31*f* to transmit a print complication notification to the PC 2 (S370*o*). Then, the main controller 31*a* deletes the print data for which the print process has been executed, from the memory part 32 (S370*p*) and ends the series of processes.

Figure 10A:
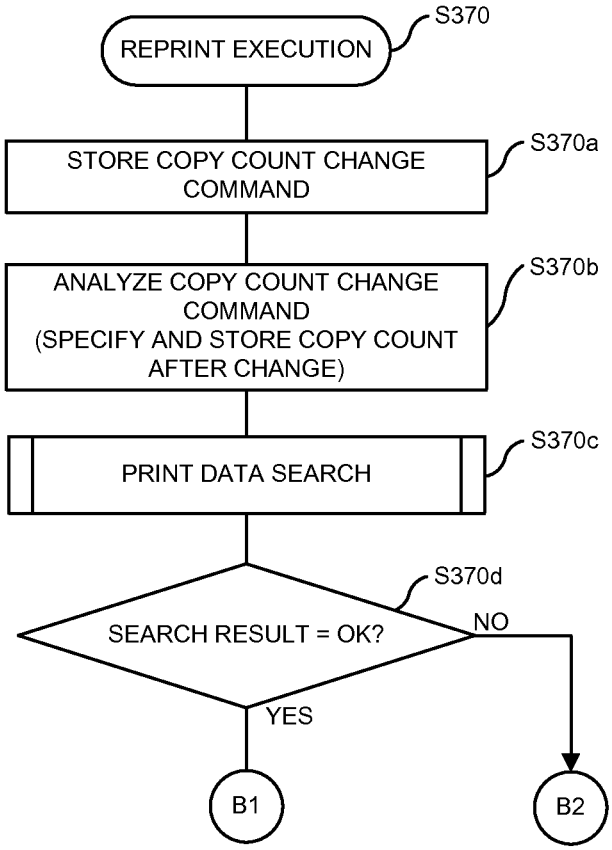
FIG. 10A is a first flow diagram illustrating an operation of the image forming device according to the first embodiment at the time of executing the reprinting.
Figure 10B:
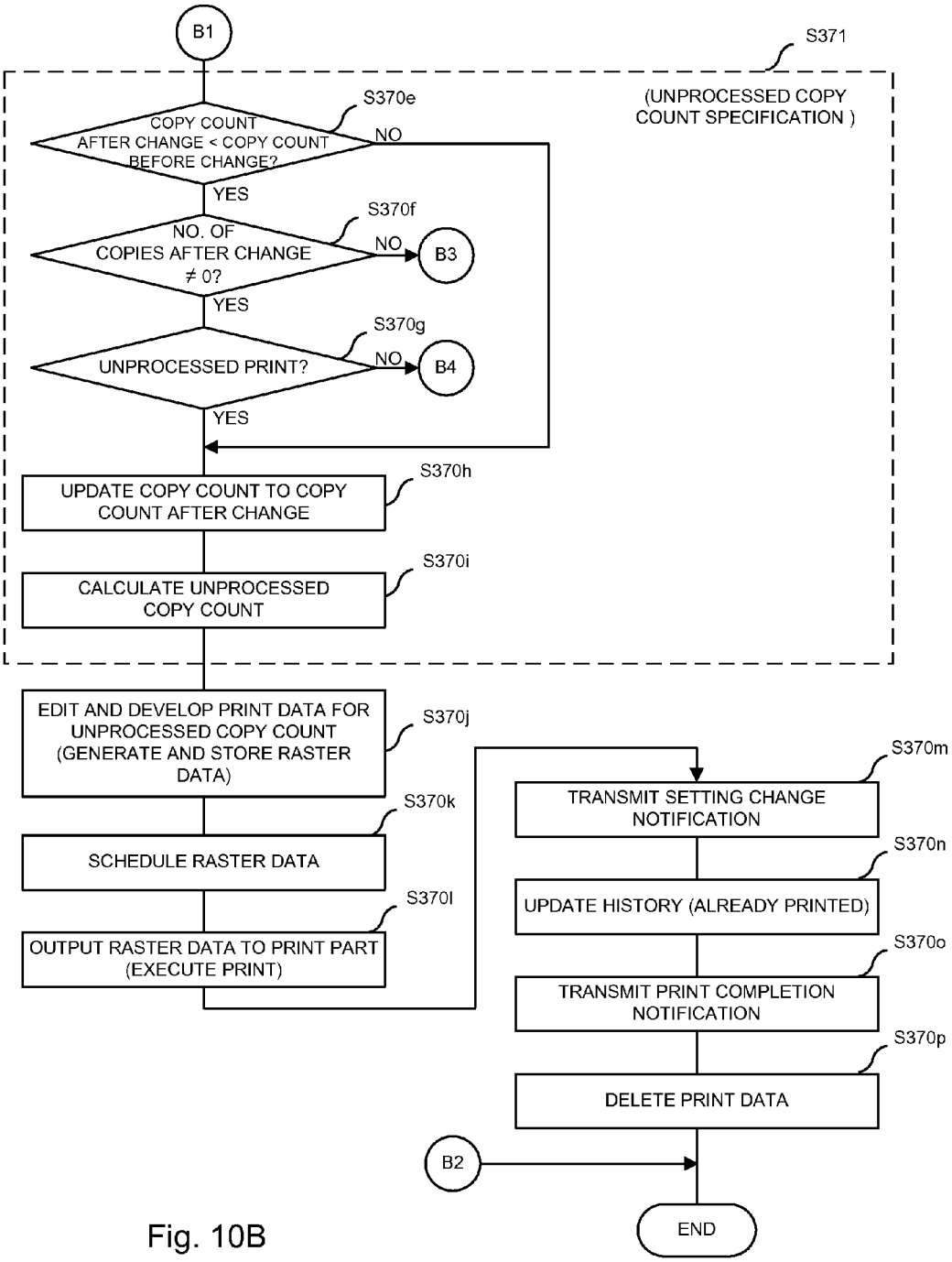
FIG. 10B is a second flow diagram illustrating the operation of the image forming device according to the first embodiment at the time of executing the reprinting.
Figure 10C:
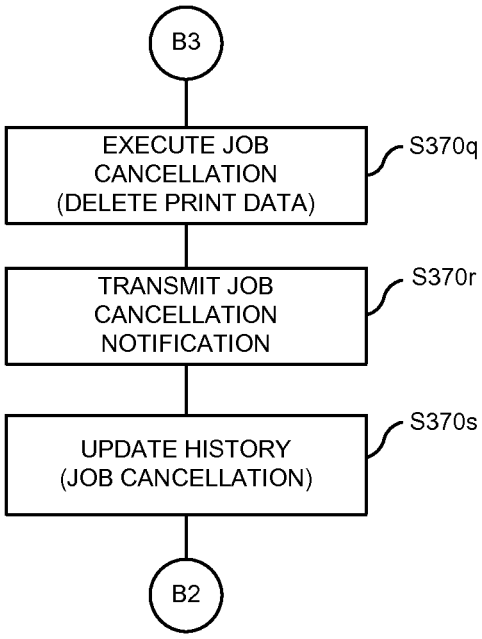
FIG. 10C is a third flow diagram illustrating the operation of the image forming device according to the first embodiment at the time of executing the reprinting.

If the determination in S370*f* shown in FIG. 10B indicates that the copy count after change is "0" ("No"), the main controller 31*a* deletes the print data stored in the memory part 32 in S310*a* shown in FIG. 7 and executes cancellation of print request (job cancellation) for the print data received in S305 shown in FIG. 6, as shown in FIG. 10C (S370*q*).

When the job cancellation is executed, the main controller 31*a* causes the notification part 31*e* and the communication controller 31*f* to transmit the setting change notification to the PC 2 to notify the PC 2 that the job cancellation has been executed (S370*r*). More specifically, the main controller outputs a setting change notification transmission request to the notification part 31*e* and the communication controller 31*f*. In response to the transmission request, the notification part 31*e* generates message data as the setting change notification that indicates that the job cancellation has been executed (e.g., "Printing has been cancelled."), and the communication controller 31*f* transmits the generated message data from the communication part 36 to the PC 2 through the LAN 6. The PC 2 receives this message data (setting change notification) in S195 shown in FIG. 2B. In response, the PC 2 displays the notification screen 114 shown in FIG. 14B, for example, on the display part 24.

After S370*r*, the main controller 31*a* updates the print interruption history data (not shown) stored in the memory part 32 so that the print interruption history data indicates that the process status of the print data changed from the interruption state to cancellation state (S370*s*) and ends the series of processes.

Figure 10D:
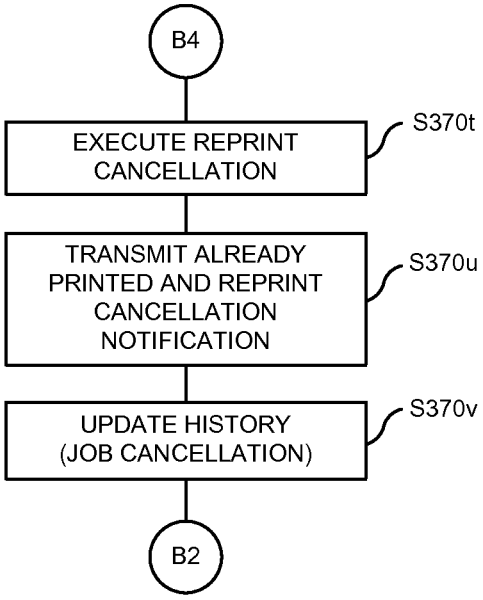
FIG. 10D is a fourth flow diagram illustrating the operation of the image forming device according to the first embodiment at the time of executing the reprinting.

Further, if the determination in S370*g* shown in FIG. 10B indicates that there is no unprocessed printing ("No"), the main controller 31*a* executes cancellation of a request (job cancellation) for changing the copy count by the copy count change command received in S365 shown in FIG. 6 and execute cancellation of a request for resuming the print process (reprinting) (hereinafter referred to as "reprint cancellation"), as shown in FIG. 10D (S370*t*).

When the reprint cancellation is executed, the main controller 31*a* causes the notification part 31*e* and the communication controller 31*f* to transmit the setting change notification to the PC 2 to notify the PC 2 that the print process for the designated copy count has been completed (already printed) and that the reprinting cancellation is to be executed (S370*u*). More specifically, the main controller 31*a* outputs a setting change notification transmission request to the notification part 31*e* and the communication controller 31*f*. In response to the transmission request, the notification part 31*e* generates message data as the setting change notification that indicates that the designated copy count has been printed and that the reprinting cancellation is to be executed (e.g., "Set copy count has already been printed. Printing will be cancelled."), and the communication controller 31*f* transmits the generated message data from the communication part 36 to the PC 2 through the LAN 6. The PC 2 receives this message data (setting change notification) in S195 shown in FIG. 2B. In response, the PC 2 displays the notification screen 113 shown in FIG. 13C, for example, on the display part 24.

After S370*u*, the main controller 31*a* updates the print interruption history data (not shown) stored in the memory part 32 so that the print interruption history data indicates that the process status of the print data indicates that printing was performed and that the reprinting cancellation was executed (S370*v*) and ends the series of processes.

<Example of Display Screen of Data Processing Device>

The explanation is made below based on the example of a display screen of the PC 2 as the data processing device with reference to FIGS. 11 to 15B. FIGS. 11 to 15B each illustrate an example of a display screen of the data processing device according to the first embodiment.

As described above, FIG. 11 illustrates a configuration example of the print setting screen 101. The PC 2 displays the print setting screen 101 on the display part 24 in S115 shown in FIG. 2A. When the user requests the printer 3 to print, the user inputs a desired value in each input area in the print setting screen 101 (e.g., input "10" in the copy count input area 101*c*) and presses the OK button 101*a*. The print setting screen 101 closes when the OK button 101*a* or the cancel button 101*b* is pressed. After that, the copy count change screen 111 (see FIG. 12) is displayed on the display part 24.

As described above, FIG. 12 illustrates a configuration example of the copy count change screen 111. The PC 2 displays the copy count change screen 111 on the display part 24 in S140 shown in FIG. 2A. When the user causes the printer to execute the print process as is without changing the copy count, the user presses the OK button 111*b* or the cancel button 111*c*. The copy count change screen 111 closes when the OK button 111*b* or the cancel button 111*c* is pressed. Moreover, when the user changes the copy count, the user inputs a desired value in the copy count input area 111*d* and presses the OK button 111*b* after pressing the interrupt button 111*a* to cause the printer 3 to interrupt the print process being executed. In this case, the copy count change screen 111 is closed at a predetermined timing, such as a timing when the print completion notice is received from the printer in S145 shown in FIG. 2A or S205 shown in FIG. 2B.

The printer 3 interrupts the print process when the user presses the interrupt button 111*a*. Thereafter, when the user inputs a desired value in the copy count input area 111*d* and presses button 111*d*, the printer 3 resumes (reprint) the print process. After that, one of notification screens 112, 113, 114 and 115 shown in FIGS. 13A to 15B is displayed (preferably for predetermined time) on the display part 24 depending on the value input in the copy count input area 111*d* in the copy count change screen 111 or depending on a status of progress of the print process by the printer 3. These notification screens 112, 113, 114 and 115 are overlaid on the copy count change screen 111 if the copy count change screen 111 is being displayed.

Figure 13B:
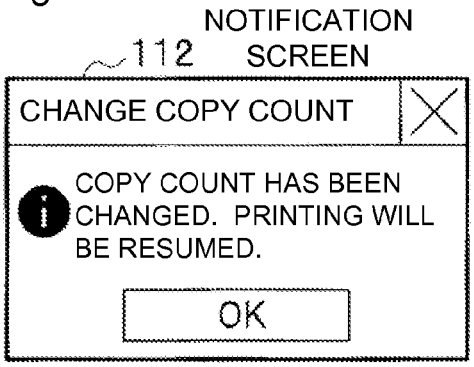
Figure 13C:
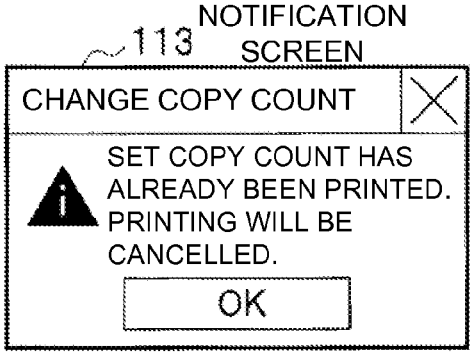

FIGS. 13A to 13C each illustrate an example of a display screen when the user inputs a value (e.g., 1), as the value of the copy count after change, that is less than the copy count before change, in the copy count input area 111*d*. In this case, the main controller 31*a* of the printer 3 determines "Yes" in S370*e* (determination process for "Copy count after change<Copy count before change?") shown in FIG. 10B and determines "Yes" in S370*f* (determination process for "Copy count after change≠0?") shown in FIG. 10B. Then, the main controller 31*a* of the printer 3 determines whether or not there is unprocessed printing in S370*g* shown in FIG. 10B.

If the determination in S370*g* indicates that there is unprocessed printing ("Yes"), the main controller 31*a* of the printer 3 transmits to the PC 2 message data as a setting change notification that indicates that the copy count has been changed and that the print process is to be resumed, in S370*m* shown in FIG. 10B. As a result, the PC 2 displays the notification screen 112 shown in FIG. 13B on the display part 24 in S200 shown in FIG. 2B.

On the other hand, if the determination in S370*g* indicates that there is no unprocessed printing ("No"), the main controller 31*a* of the printer 3 transmits to the PC 2 message data as the setting change notification that indicates that the designated copy count has been printed and that reprinting is to be cancelled, in S370*u* shown in FIG. 10D. As a result, the PC 2 displays the notification screen 113 shown in FIG. 13C on the display part 24 in S200 shown in FIG. 2B.

Figure 14A:
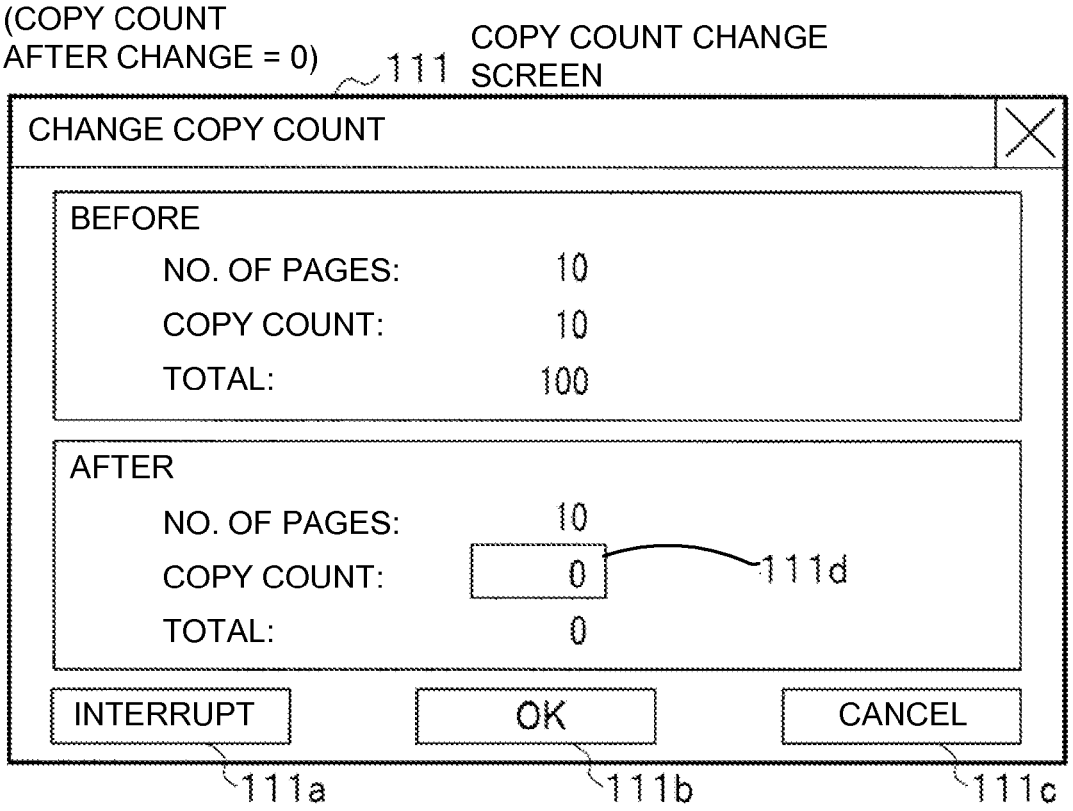
FIGS. 14A and 14B are fourth diagrams illustrating examples of the display screen of the data processing device according to the first embodiment.
Figure 14B:
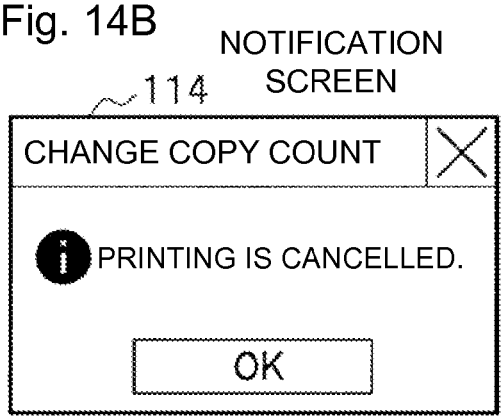

FIGS. 14A and 14B each illustrate an example of a display screen when the user inputs "0" as a value of the copy count after change in the copy count input area 111*d*. In this case, the main controller 31*a* of the printer 3 determines "Yes" in S370*e* (determination process for "Copy count after change<Copy count before change?") shown in FIG. 10B and determines "No" in S370*f* (determination process for "Copy count after change≠0?") shown in FIG. 10B. Then, the main controller 31*a* of the printer 3 transmits to the PC 2 message data as the setting change notification that indicates that the job cancellation has been executed, in S370*r* shown in FIG. 10C. As a result, the PC 2 displays the notification screen 114 shown in FIG. 14B on the display part 24 in S200 shown in FIG. 2B.

Figure 15A:
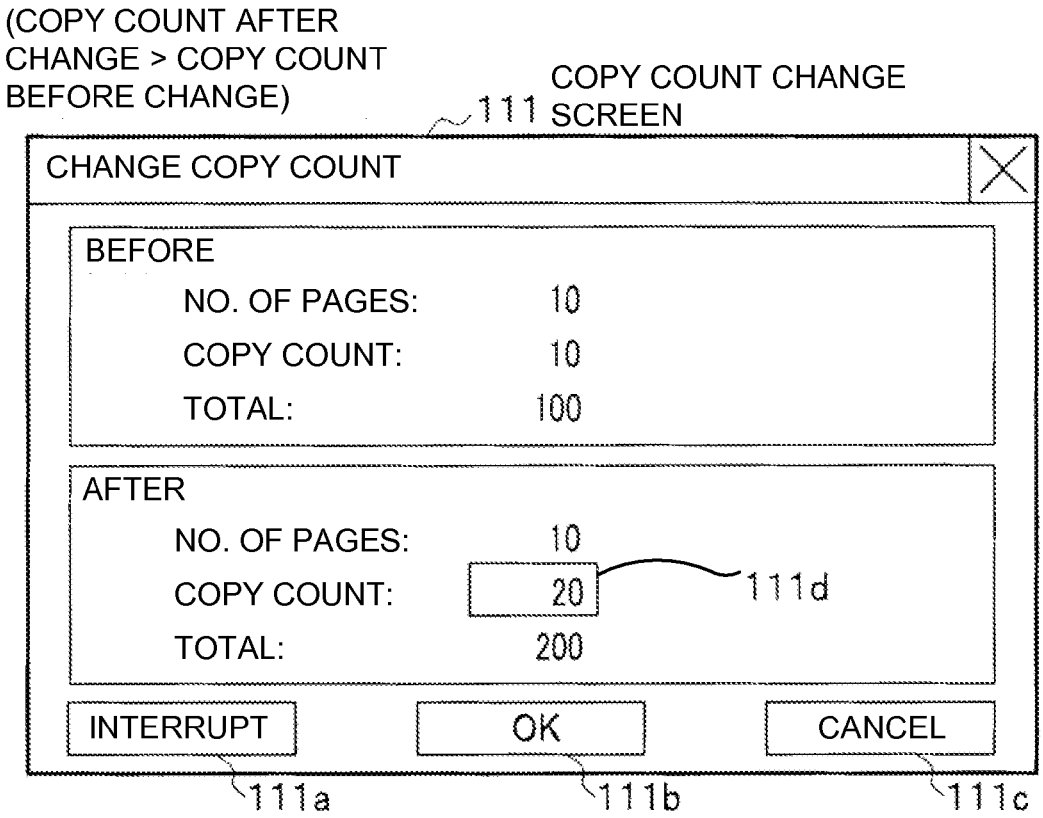
FIGS. 15A and 15B are fifth diagrams illustrating examples of the display screen of the data processing device according to the first embodiment.
Figure 15B:
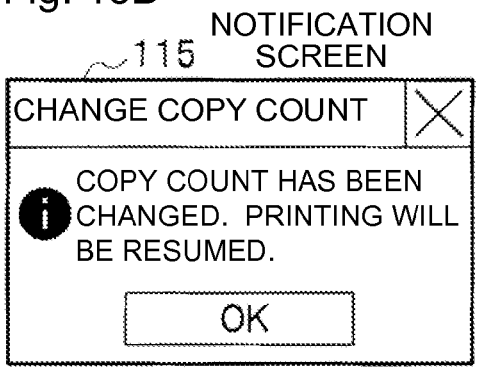

FIGS. 15A and 15B each illustrate an example of a display screen when the user inputs a value (e.g., 20), as the value of the copy count after change, that is more than the copy count before change, in the copy count input area 111*d*. In this case, the main controller 31*a* of the printer 3 determines "No" in S370*e* (determination process for "Copy count after change<Copy count before change?") shown in FIG. 10B. Then, the main controller 31*a* of the printer 3 transmits to the PC 2 message data as the setting change notification that indicates that the copy count has been changed and that the print process is to be resumed, in S370*m* shown in FIG. 10B. As a result, the PC 2 displays the notification screen 115 shown in FIG. 15B on the display part 24 in S200 shown in FIG. 2B.

As a result, the PC 2 as the data processing device according to claim 1 displays the copy count change screen 111 on the display part 24 when the print data is transmitted to the printer 3. Therefore, when the user changes the copy count, because user can determine preferable settings for the respective print setting items based on the settings displayed on the copy count change screen 111, the user need not memorize the past print settings or manually input the print settings. Accordingly, the data processing device reduces the user's burden to change the copy count.

With the conventional data processing device, when a print job is to be cancelled, the designation of a job ID to be cancelled is often time consuming, causing difficulty in executing the job cancellation.

Specifically, in the conventional data processing device, when the user cancels a print instruction, the data processing device displays on a display part job IDs received from an image forming device and asks the user to designate a job ID to be cancelled. At this time, if there is a plurality of job IDs, the plurality of job IDs are listed. However, if there is a large number of job IDs, the user spends time to find the job ID to be cancelled. Therefore, while the user is finding the job ID to be cancelled, or even if the user finds it, while the user is selecting the job ID to be cancelled by predetermined steps, the print process may be completed. As a result, the conventional data processing device, the job cancellation may not be executed. Especially, an image forming device that prints a job with high priority first has recently been proposed. In this device, because the job order may not be in sequence, it is time consuming to find a job ID to be cancelled. As a result, cases in which the job cancellation is not executed are presumably increased.

In contrast, the PC 2 according to the first embodiment interrupts the print process merely by displaying the copy count change screen 111 (see FIG. 12) on the display part 24 and having the user press the interrupt button 111*a* displayed on the copy count change screen 111, in conjunction with the transmission of the print data. As a result, the data processing device 2 simplifies steps for finding the job ID to be cancelled and steps for selecting the job ID to be cancelled. As such, the user can designate the job ID to be cancelled at a short period of time. Therefore, the data processing device 2 executes job cancellation at a higher rate than the conventional data processing device.

As described above, according to the data processing device according to the first embodiment, when the user changes the copy count, the user can determine a preferable setting for each print setting item based on the settings displayed in the copy count change screen. Therefore, the user need not memorize the past print settings or manually input the print settings. Therefore, the data processing device reduces the burned at the user for changing the copy count.

In addition, the data processing device simplifies steps for finding the job ID to be cancelled and steps for selecting the job ID to be cancelled. As such, the user can designate the job ID to be cancelled at a short period of time.

Therefore, the data processing device executes job cancellation at a high rate.

Moreover, according to the image forming device of the first embodiment, when a print interrupt command that instructs interruption of the print process and a copy count change command that instruct change in the copy count for the print data is received from the data processing device, the unprocessed copy count is specified, and the print process for the unprocessed copy count is executed. Because the image forming device automatically executes the print process for the unprocessed copy count, the user needs not count the copy count that the image forming device printed, to determine whether or not there is any insufficient copy count. If there is insufficient copy count, the user needs to specify the insufficient copy count and change the print configurations. Accordingly, the image forming device reduces the user's burden to change the copy count.

Second Embodiment

<Configuration of Data Processing Device and Image Forming Device>

Figure 19:
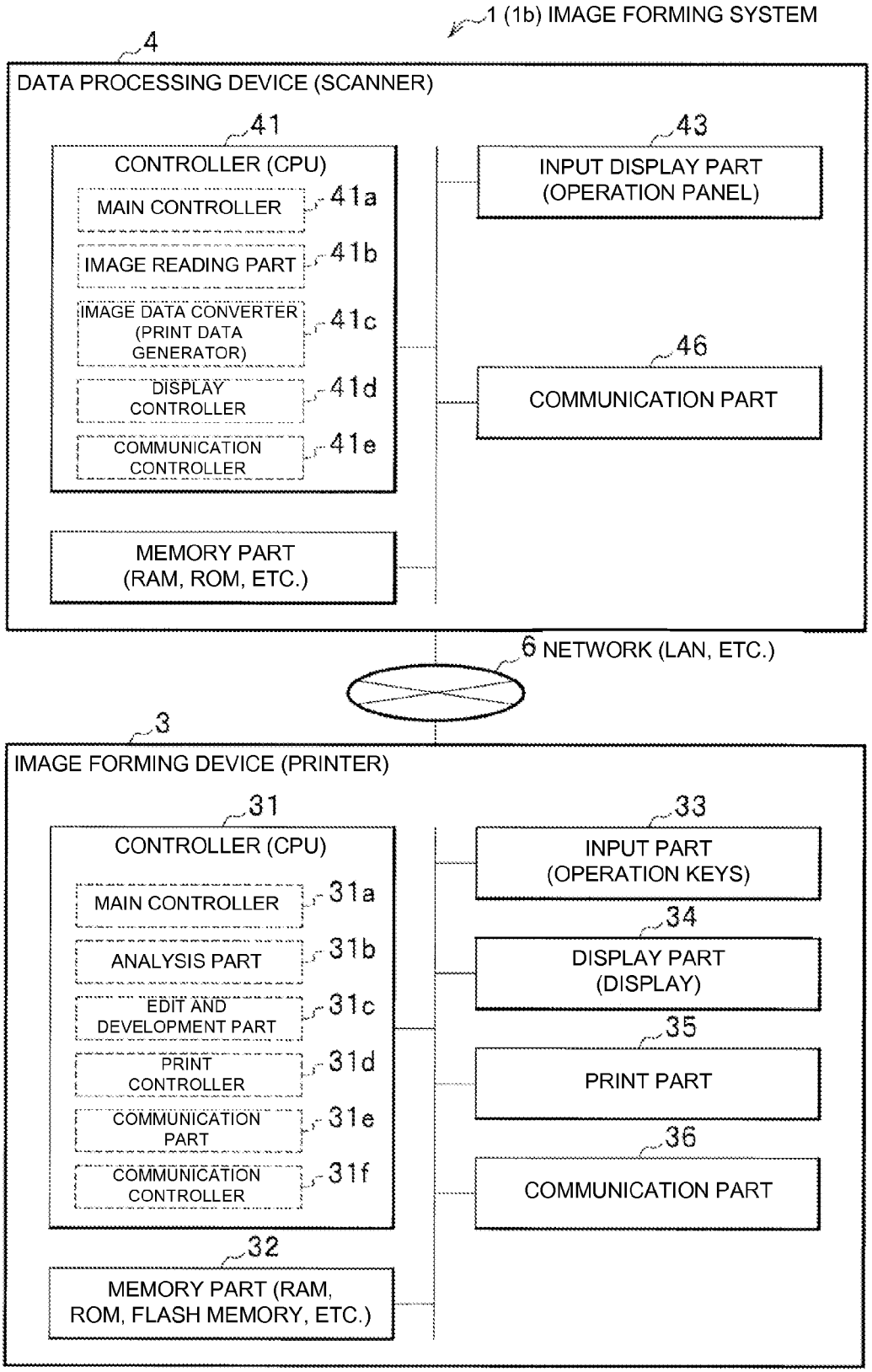
FIG. 19 illustrates a configuration of a data processing device and an image forming device according to a second embodiment.

In a second embodiment, the data processing device is configured as a scanner. A configuration of a data processing device and an image forming device according to the second embodiment is explained below with reference to FIG. 19. FIG. 19 illustrates a configuration of a data processing device and an image forming device according to the second embodiment.

As shown in FIG. 1, an image forming system 1 (1*b*) according to the second embodiment is configured with a scanner 4 as the data processing device and the printer 3 as the image forming device, which are communicatably connected through a network 6, such as LAN or the like. The configuration of the printer 3 has already been explained in the first embodiment. Therefore, the detailed description of the printer 3 is omitted here.

Similar to the PC 2 in the first embodiment, the scanner 4 includes a function to transmit to the printer 3 various command, such as the print interruption command, copy count change command and the like.

Different from a general scanner, the scanner 4 includes a function to receive various notifications, such as a print completion notification, a setting change notification and the like, from the printer 3 and to switch a screen to display on a display part (input display part 43) when a notification are received.

The scanner 4 actively obtains the various notifications from the printer 4. More specifically, as the scanner 4 transmits to the printer 3 commands, such as a print command (copy command), a print interruption command, a copy count change print and the like, the printer 3 transmits to the scanner 4 various notifications as response to the commands.

The scanner 4 includes a controller 41, a memory part 42, an input display part 43 and a communication part 46. The controller 41, memory part 42, input display part 43 and communication part 46 are components that correspond to the controller 21, memory part 22 and the communication part, respectively, in the first embodiment. In addition, the input display part 43 is a component that includes functions of both the input part 23 and the display part 24 in the first embodiment.

The controller 41 is a component that controls the operation of the scanner 4 and is realized by a CPU to execute a control program stored in a ROM and the like. The memory part 42 is a component that stores various data and programs and is configured from a random access memory, ROM and the like.

The input display part 43 is a component that displays various images and that allows the user to input various data and instructions. The input display part 43 is configured from a touch panel type operational panel. The communication part 46 is a component that transmits and receives various data (including commands) and is configured from an input/output (I/O) port.

The controller 41 functions as a main controller 41*a*, an image reading part 41*b*, an image data converter 41*c*, a display controller 41*d* and a communication controller 41*e*.

The main controller 41*a* and the communication controller 41*e* are functional parts that correspond to the main controller 21*a* and the communication controller 21*d*, respectively, in the first embodiment. The image reading part 41*b* is a functional part that optically reads a document and obtains (generates) read image data of the document.

The image data converter 41*c* is a functional part that converts the read image data obtained by the image reading part 41*b* into image data in a format printable at the printer 3. The image data converter 41*c* functions as a print data generator that generates print data by associating a print command (copy command) with the converted image data. In addition, the image data converter 41*c* also generates various commands, such as the print interruption command, copy count change command and the like. The display controller 41*d* is a functional means that corresponds to the display controller 21*c* in the first embodiment and controls display operations of the input display part 43.

<Operation of Data Processing Device and Image Forming Device>

Figure 20:
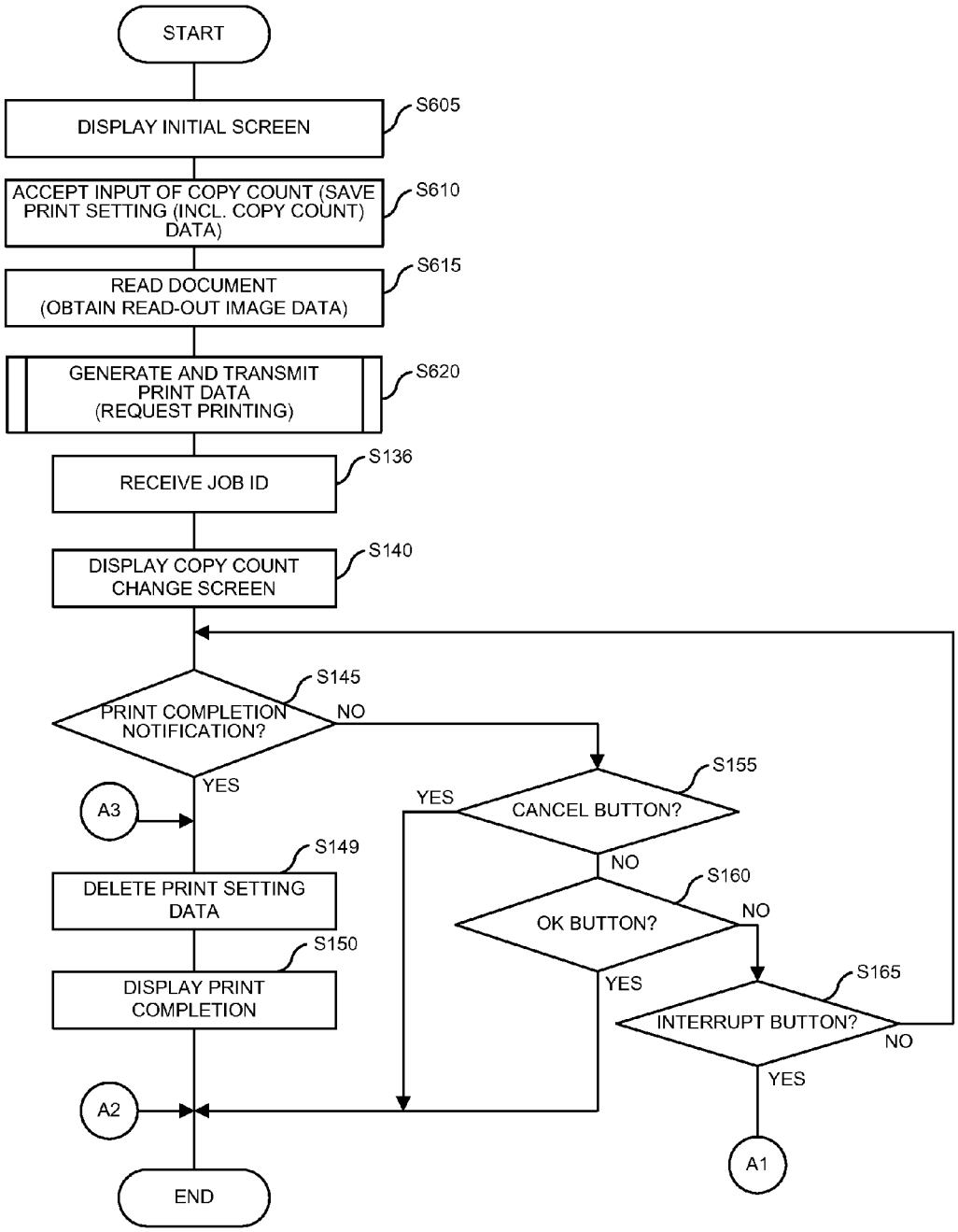
FIG. 20 is a flow diagram illustrating an entire operation of the data processing device according to the second embodiment.

The operation of the data processing device (scanner 4) according to the second embodiment is explained below with reference to FIGS. 20 and 2B. FIG. 20 is a flow diagram illustrating the entire operation of the data processing device according to the second embodiment.

Similar to the PC 2 according to the first embodiment, the scanner 4 according to the second embodiment executes the process shown in FIG. 2B when the determination in S165 shown in FIG. 20 indicates that the interrupt button 111A is pressed ("Yes").

Moreover, the operation of the image forming device (printer 3) according to the second embodiment is the same as the operation of the image forming device (printer 3) according to the first embodiment shown in FIG. 6. Therefore, the operation of the image forming device according to the second embodiment are understood from the operation of the image forming device according to the above-described first embodiment, and thus the detailed explanations are omitted.

(Operation of Data Processing Device)

When the user turn on the power or when the user touches the input display part 43 during a power saving mode, the scanner 4 starts the series of processes. Here, it is assumed that a document has been set on the scanner 4 and that a print process has not been executed by the printer 3.

As shown in FIG. 20, compared with the operation (see FIGS. 2A and 2B) of the PC 2 according to the first embodiment, the operation of the scanner 4 according to the second embodiment is different in that the scanner 4 performs the processes in S605 to S620, whereas the PC 2 according to the first embodiment executes the processes in S105 to 135. The operation of the scanner 4 in a case when the determination in S165 indicates that the interrupt button 111*a* is pressed ("Yes") is the same as the operation of the PC 2 according to the first embodiment shown in FIG. 2B. Therefore, the operation of the scanner when the determination in S165 is "Yes" is understood from the operation of the above-described operation of the PC 2 shown in FIG. 2B. Therefore, detailed explanations are omitted.

Next, the explanation of the processes of the scanner 4 in S605 to S620 is focused. First, as shown in FIG. 20, the main controller 41*a* of the scanner 4 causes the input display part 43 to display the initial screen 601 shown in FIG. 22, for example (S605). More specifically, the main controller 41*a* outputs a display request for the initial screen 601 to the display controller 41*d*. When the display request is inputted from the main controller 41*a*, the display controller 41*d* reads out the image data from the memory part 42 for displaying the initial screen 601, outputs the image data to the input display part 43 and causes the input display part 43 to display the initial screen 601. The operation of the main controller 41*a* and the display controller 41*d* for displaying various screens on the input display part 43. Therefore, the explanation is omitted below.

Figure 22:
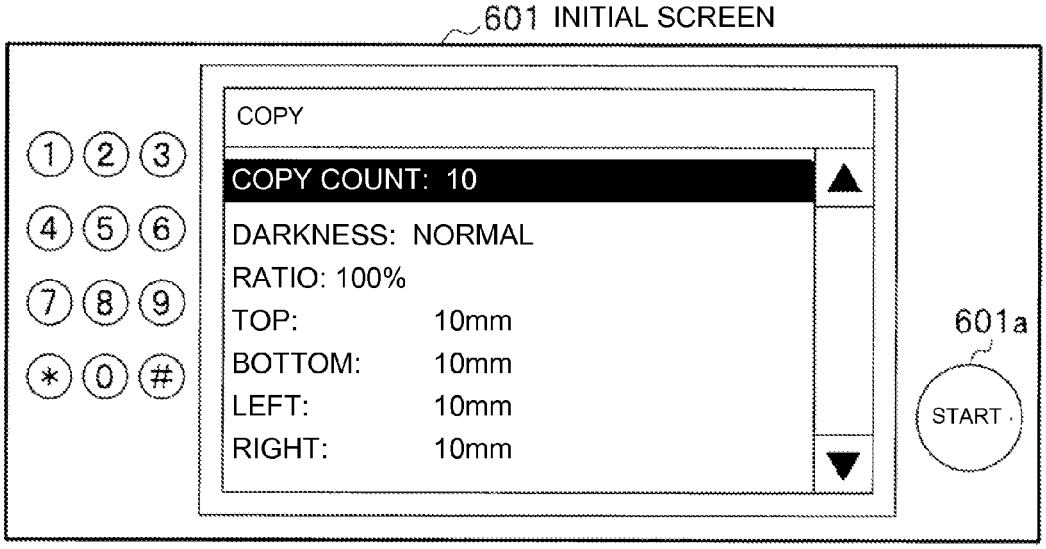
FIG. 22 is a first diagram illustrating an example of a display screen of the data processing device according to the second embodiment.
Figure 23:
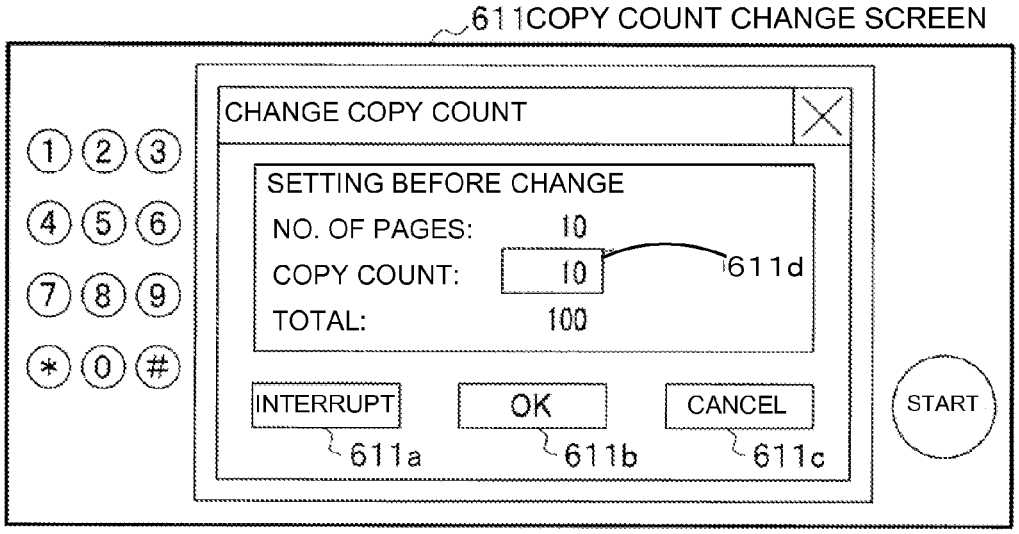
FIG. 23 is a second diagram illustrating an example of the display screen of the data processing device according to the second embodiment.
Figure 24A:
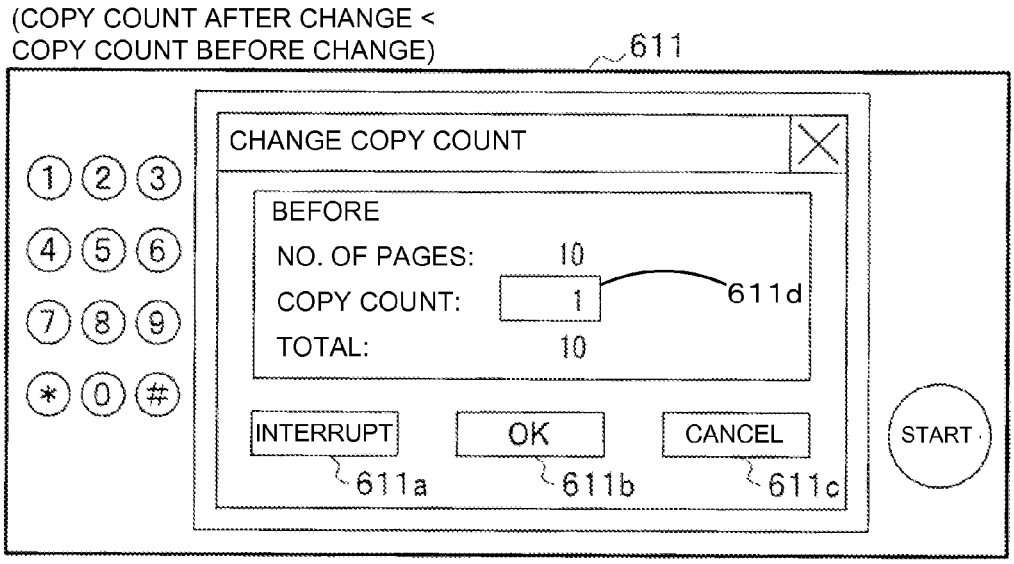
FIGS. 24A to 24C are third diagrams illustrating examples of the display screen of the data processing device according to the second embodiment.
Figure 24B:
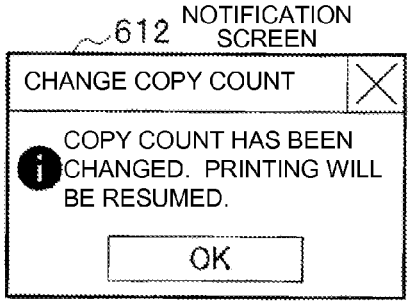
Figure 24C:
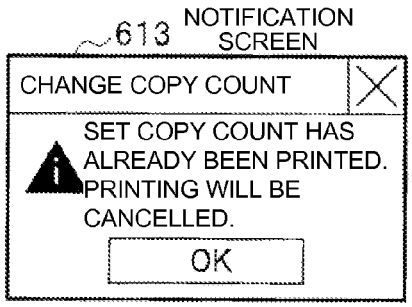

FIG. 22 is a diagram illustrating an example of a display screen of the data processing device according to the first embodiment and illustrates a configuration example of the initial screen 601. The "initial screen 601" is a dialog box for instructing to print (copy) an image of the document set on the scanner 4. In the example shown in FIG. 22, the initial screen 601 includes a start button 601*a*, a numerical keypad, a plurality of print setting items (input areas) for inputting desired print settings including the copy count, and the like.

For instructing the printer to print (copy) the image of the document set on the scanner 4, the user selects predetermined items in the respective print setting items by moving a cursor (black line part) displayed in the initial screen 601 and presses the start button 601*a* after appropriately inputting the desired print settings by operating the numerical keypad. Here, the user inputs a desired copy count (e.g., "10") in the copy count input area in the initial screen 601 and presses the star button 601*a*.

When the user presses the start button 601*a*, the main controller 41*a* of the scanner 4 accepts the print settings inputted in the respective print setting items in the initial screen 601 (S610). At this time, the main controller 41*a* saves in the memory part 42 the values of the print settings inputted in the respective print setting items in the initial screen 601 (especially, the copy count inputted in the "copy count" input area shown in FIG. 22) as the print setting data. In the memory part 42, print setting data, such as scanner name, IP address, port name and the like, is stored in advance. The print setting data that includes the copy count data is used for generating the print data, print interruption command, copy count change command and the like.

After S610, the main controller 41*a* causes the image reading part 41*b* to read the document and to obtain read image data (S615). More specifically, the main controller 41*a* outputs a document reading request to the image reading part 41*b*. When the document reading request is inputted from the main controller 41*a*, the image reading part 41*b* optically reads the document, obtains read image data and stores the obtained read image data in the memory part 42.

Figure 21:
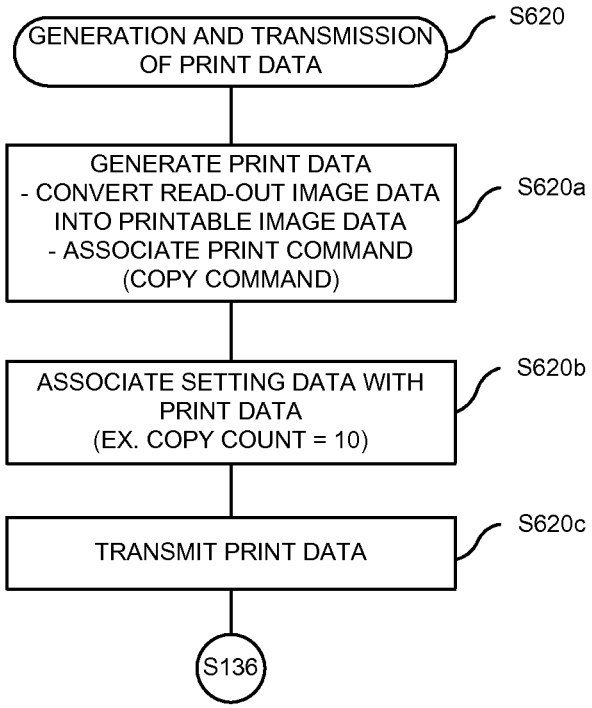
FIG. 21 is a flow diagram illustrating an operation of the data processing device according to the second embodiment at the time of generating and transmitting print data.

When the read image data is obtained by the image reading part 41*b*, the main controller 41*a* causes the image data converter 41*c* and the communication controller 41*e* to execute a "print data generation and transmission" process and requests the printer to print (S620). The printer starts the print process by receiving the print data from the scanner 3 in S305 shown in FIG. 6. Details of S620 are shown in FIG. 21. FIG. 21 is a flow diagram illustrating an operation of the data processing device according to the second embodiment at the time of generating and transmitting the print data.

As shown in FIG. 21, the main controller 41*a* first causes the image data converter 41*c* to generate print data (S620*a*). In particular, the main controller 41*a* outputs a print data generation request to the image data converter 41*c*. When the print data generation request is inputted from the main controller 41*a*, the image data converter 41*c* converts the read image data into image data in a printable format and associates a print command (copy command) with the image data to generate the print data. The "copy command" is a control command for instructing the printer 3 to print the read image of the document and is substantially the same as the print command.

When the print data is generated, the main controller 41*a* reads out the print setting data (e.g., copy count, scanner name, IP address, port name, etc.) from the memory part 42, sets "print (copy" as a job type, and causes the image data converter 41*c* to associate the print setting data with the print data (S620*b*). More specifically, the main controller 41*a* outputs an association request of the print setting data with the print data to the image data converter 41*c*. When the association request of the print setting data with the print data is inputted from the main controller 41*a*, the image data converter 41*c* associates the print data association setting data show in FIG. 27 with the print data. Here, the explanation is made with an assumption that the image data converter 41*c* associates the setting data 701 that sets the copy count to "10" with the print data. Hereinafter, the print data with which the setting data 701 has been associated is also simply referred to as "print data." For example, the image data convertor 41*c*, which is the print data generator, generates several different page image data (in this example, page image data composed of ten different pages) from the document data as the image data used for the print process according to instructions of the main controller 41*a*. Further, according to instructions of the main controller 41*a*, the image data convertor 41*c* adds setting data, which designate the copy count to be 10 copies, to the print data so that the image data convertor 41*c* generates the print data of total 100 pages by which 10 copies for each of the ten pages are made.

FIG. 27 is a diagram illustrating a configuration of the setting data used in the second embodiment. FIG. 27 indicates, as the setting data 701, a job type, setting items, such as copy count, scanner name, IP address, port name and the like, and values corresponding to the respective setting items.

After S620*b*, the main controller causes the communication controller 41*e* to transmit the print data to the printer (S620*c*). At this time, the communication controller 41*e* transmits the print data from the communication part 46 to the printer 3 through the LAN 6. When the print data is received from the scanner, the printer 3 associates a job ID with the print data and notifies the scanner 4 of the job ID. After that, the process moves to S136 shown in FIG. 20.

The main controller 41*a* of the scanner 4 receives the job ID from the printer (S136). Then, the main controller 41 a associates the job ID with the print setting data that includes the copy count data stored in the memory part 42 and stores the job ID in the memory part 42. The job ID stored in the memory part 42 is used for generation of setting data 702 and 703 (see FIGS. 28 and 29) that is associated with the print interruption command or the copy count change command when the print interruption command is transmitted to the printer 3 in S170 shown in FIG. 2B or when the copy count change command is transmitted to the printer 3 in S190 shown in FIG. 2B. Here, the explanation is made with an assumption that an ID generated by the printer 3 is used as the job ID. However, the scanner 4 may generate the ID, and such ID may be used.

Thereafter, the scanner 4 operates in the same manner as the PC 2 according to the first embodiment. However, in the second embodiment, the image data converter 41*c* forms the print data generator and executes the process similar to that by the print data generation part 21*b* in the first embodiment.

Further, in the second embodiment, when the print interruption request is inputted from the main controller 21*a* in S170*a* shown in FIG. 4, the image data converter 41*c* associates the print interruption command association setting data 702 shown in FIG. 28, for example, with the print interruption command. FIG. 28 is a diagram illustrating a configuration of the setting data used in the second embodiment. FIG. 28 indicates, as the setting data 702, a job type, setting items, such as copy count, scanner name, IP address, port name and the like, and values corresponding to the respective setting items.

Further, in the second embodiment, when the copy count change request is inputted from the main controller 21*a* in S190*a* shown in FIG. 5, the image data converter 41*c* associates the copy count change command association setting data 703 shown in FIG. 29, for example, with the print interruption command.

FIG. 29 is a diagram illustrating a configuration of the setting data used in the second embodiment. FIG. 29 indicates, as the setting data 703, a job type, setting items, such as copy count, copy count, scanner name, IP address, port name and the like, and values corresponding to the respective setting items.

<Example of Display Screen of Data Processing Device>

Below, examples of display screen of the scanner 4 as the data processing device are explained with reference to FIGS. 22 to 26B. FIGS. 22 to 26B each illustrate an example of a display screen of the data processing device according to the second embodiment.

As described above, FIG. 22 illustrates a configuration example of an initial screen 601. The scanner displays the initial screen 601 on the input display part 43 in S605 shown in FIG. 20. When the user requests printing to the printer, the user inputs desired values in the respective input areas (e.g., input "10" in the "copy count" input area) in the initial screen 601 and presses the start button 601*a*. The initial screen 601 closes when the start button 601*a* is pressed. After that, a copy count change screen 611 (see FIG. 23) is displayed on the input display part 43.

As described above, FIG. 23 illustrates a configuration example of the copy count change screen 611. The scanner 4 displays the copy count change screen 611 on the input display part 43 in S140 shown in FIG. 20. When the user causes the printer to execute the print process as is without changing the copy count, the user presses the OK button 611*b* or the cancel button 611*c*. The copy count change screen 611 closes when the OK button 611*b* or the cancel button 611*c* is pressed. Moreover, when the user changes the copy count, the user inputs a desired value in the copy count input area 611*d* and presses the OK button 611*b* after pressing the interrupt button 611*a* to cause the printer 3 to interrupt the print process being executed. In this case, the copy count change screen 611 is closed at a predetermined timing, such as timing when the print completion notice is received from the printer in S145 shown in FIG. 20 or S205 shown in FIG. 2B.

The printer 3 interrupts the print process when the user presses the interrupt button 611*a*. Thereafter, when the user inputs a desired value in the copy count input area 611*d* and presses button 611*d*, the printer 3 resumes (reprint) the print process. After that, one of notification screens 612, 613, 614 and 615 shown in FIGS. 24 to 26B is displayed (preferably for predetermined time) on the input display part 43 depending on the value input in the copy count input area 611*d* in the copy count change screen 611 or depending on a status of progress of the print process by the printer 3. These notification screens 612, 613, 614 and 615 are overlaid on the copy count change screen 611 if the copy count change screen 611 is being displayed FIGS. 24A to 24C each illustrate an example of a display screen when the user inputs a value (e.g., 1), as the value of the copy count after change, that is less than the copy count before change, in the copy count input area 611*d*. In this case, the main controller 31*a* of the printer 3 determines "Yes" in S370*e* (determination process for "Copy count after change<Copy count before change?") shown in FIG. 10B and determines "Yes" in S370*f* (determination process for "Copy count after change≠0?") shown in FIG. 10B. Then, the main controller 31*a* of the printer 3 determines whether or not there is unprocessed printing in S370*g* shown in FIG. 10B.

If the determination in S370*g* indicates that there is unprocessed printing ("Yes"), the main controller 31*a* of the printer 3 transmits to the scanner 4 message data as a setting change notification that indicates that the copy count has been changed and that the print process is to be resumed, in S370*m* shown in FIG. 10B. As a result, the scanner 4 displays the notification screen 612 shown in FIG. 24B on the input display part 43 in S200 shown in FIG. 2B.

On the other hand, if the determination in S370*g* indicates that there is no unprocessed printing ("No"), the main controller 31*a* of the printer 3 transmits to the scanner 4 message data as the setting change notification that indicates that the designated copy count has been printed and that reprinting is to be cancelled, in S370*u* shown in FIG. 10D. As a result, the scanner 4 displays the notification screen 613 shown in FIG. 24C on the input display part 43 in S200 shown in FIG. 2B.

Figure 25A:
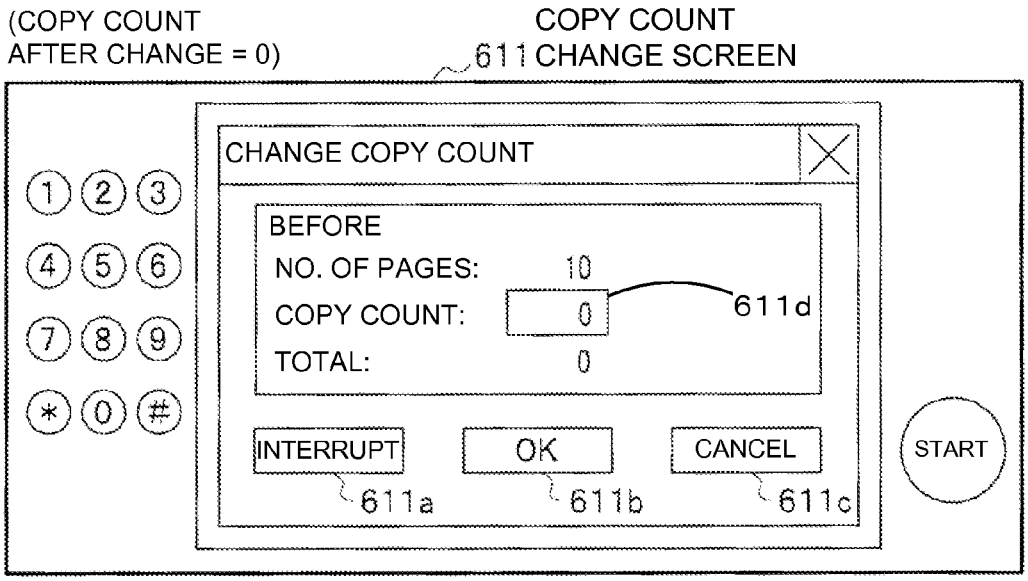
FIGS. 25A and 25B are fourth diagrams illustrating examples of the display screen of the data processing device according to the second embodiment.
Figure 25B:
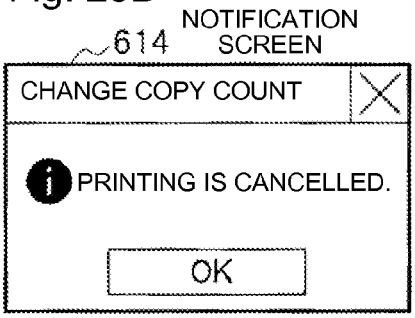

FIGS. 25A and 25B each illustrate an example of a display screen when the user inputs "0" as a value of the copy count after change in the copy count input area 611*d*. In this case, the main controller 31*a* of the printer 3 determines "Yes" in S370*e* (determination process for "Copy count after change<Copy count before change?") shown in FIG. 10B and determines "No" in S370*f* (determination process for "Copy count after change≠0?") shown in FIG. 10B. Then, the main controller 31*a* of the printer 3 transmits to the scanner 4 message data as the setting change notification that indicates that the job cancellation has been executed, in S370*r* shown in FIG. 10C. As a result, the scanner 4 displays the notification screen 614 shown in FIG. 25B on the input display part 43 in S200 shown in FIG. 2B.

Figure 26A:
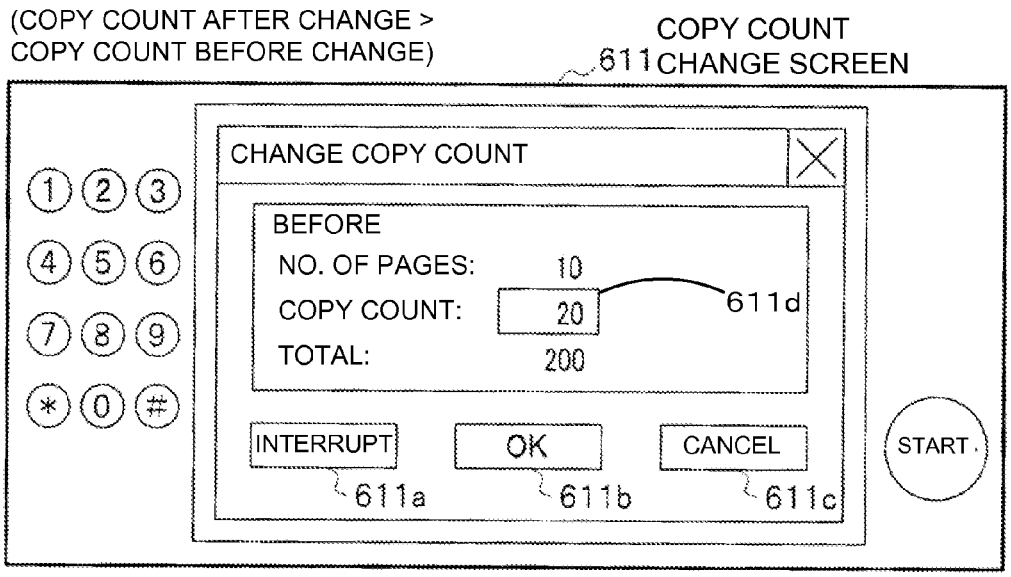
FIGS. 26A and 26B are fifth diagrams illustrating examples of the display screen of the data processing device according to the second embodiment.
Figure 26B:
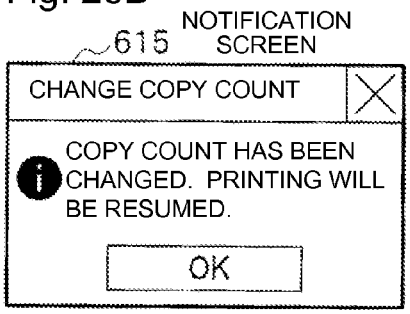

FIGS. 26A to 26B each illustrate an example of a display screen when the user inputs a value (e.g., 20), as the value of the copy count after change, that is more than the copy count before change, in the copy count input area 611*d*. In this case, the main controller 31*a* of the printer 3 determines "No" in S370*e* (determination process for "Copy count after change<Copy count before change?") shown in FIG. 10B. Then, the main controller 31*a* of the printer 3 transmits to the scanner 4 message data as the setting change notification that indicates that the copy count has been changed and that the print process is to be resumed, in S370*m* shown in FIG. 10B. As a result, the scanner 4 displays the notification screen 615 shown in FIG. 26B on the input display part 43 in S200 shown in FIG. 2B.

As described above, according to the second embodiment, in addition to the PC, the scanner also realizes the data processing device. As described above, according to the data processing device according to the first embodiment, when the user changes the copy count, the user can determine a preferable setting for each print setting item based on the settings displayed in the copy count change screen. Therefore, the user need not memorize the past print settings or manually input the print settings.

Accordingly, the user's burden to change the copy count is reduced.

In addition, similar to the data processing device according to the first embodiment, the data processing device according g to the second embodiment simplifies steps for finding the job ID to be cancelled and steps for selecting the job ID to be cancelled. As such, the user can designate the job ID to be cancelled at a short period of time. Therefore, the data processing device executes job cancellation at a high rate.

The present embodiments are not limited to those described above, and various changes and modifications are available without departing from the scope of the invention. For example, the image forming device is not limited to a printer but may be a multifunction printer (MFP) or a facsimile device that has a function to print by designation of the copy count.

What is claimed is:

1. A data processing device that transmits a control command and print data to an image forming device, comprising:

a communication part that executes communication with the image forming device;

an input part to which an instruction for the image forming device is inputted;

a display part that displays images;

a print data generator that generates the control command and the print data;

a communication controller that controls the communication by the communication part;

a memory part that stores data including the print data; and a main controller that controls operation of the communication part, the input part, the display part, the print data generator, the communication controller and the memory part, wherein when the main controller causes the print data generator to generate the print data and to associate setting data that includes copy count data that designates a copy count of the print data with the print data, and when the main controller causes the communication controller to transmit the print data, with which the setting data is associated, to the image forming device, the main controller causes the memory part to save the setting data at least until the main controller receives a notification, which indicates completion of a print process of the print data, from the image forming device, and the main controller causes the display part to display a screen, as a copy count change screen for instructing a change in the copy count, that displays settings of the print data that is changeable by the input part, the settings of the print data including the copy count designated by the copy count data, wherein when a print interruption command, which instructs interruption of the print process of the print data, and a copy count change command, which indicates the change in the copy count for the print data, are sequentially transmitted to the image forming device, and when notifications, which indicate that the copy count has been changed and that the print process has resumed, are received, as a response to the copy count change command, from the image forming device, the main controller causes the display part to display a notification screen that indicates the change in the copy count and resuming of printing.

2. The data processing device according to claim 1, wherein the copy count change screen displays selectably a plurality of operational keys that correspond to control commands for interrupting the print process and for changing the copy count.

3. The data processing device according to claim 1, wherein when the print interruption command and the copy count change command are sequentially transmitted to the image forming device and when a notification, which indicates that the printing has completed and that the print process has been cancelled, is received, as a response to the copy count change command, from the image forming device, the main controller causes the display part to display a notification screen that indicates that the print data has been printed and that the printing has been cancelled.

4. The data processing device according to claim 1, wherein when the print interruption command and the copy count change command are sequentially transmitted to the image forming device, and when a notification, which indicates that the print process has been cancelled, is received, as a response to the copy count change command, from the image forming device, the main controller causes the display part to display the notification that indicates cancellation of print.

5. The data processing device according to claim 1, wherein the data processing device is configured as a personal computer.

6. The data processing device according to claim 1, wherein the data processing device is configured as a scanner.

7. The data processing device according to claim 1, wherein the print data includes page images of multiple different pages, and the copy count includes a numerical value to which a number of copies of each of the page images is equal.

8. An image forming device that forms an image based on print data generated by a data processing device, comprising:

a communication part that executes communication with the data processing device;

a memory part that stores control commands and the print data that includes setting data received from the data processing device;

a print part that executes a print process based on the print data;

a notification part that generates a notification to the data processing device and transmits the notification via the communication part; and a main controller that controls operation of the communication part, the memory part, the print part and the notification part, wherein when the print data is received, with which the setting data that includes copy count data designating a copy count is attached, the main controller stores the print data in the memory part from the data processing device, and causes the print part to execute the print process for the copy count based on the print data, and when a print interruption command that instructs interruption of the print process of the print data and a copy count change command that instructs a change in the copy count for the print data are sequentially received from the data processing device, after storing in the memory part history data that includes a printed copy count at time of interruption, the main controller specifies an unprocessed copy count based on the history data and the copy count change command, and causes the print part to execute the print process for the unprocessed copy count based on the print data.

9. The image forming device according to claim 8, further comprising:

an analysis part that analyzes the print data and the control commands received from the data processing device;

an edit and development part that generates printable image data by editing and developing the print data stored in the memory part; and a print controller that causes the print part to print images based on the image data, wherein when the print data is received from the data processing device, the main controller causes the analysis part to analyze the print data and to obtain the copy count data, causes the edit and development part to generate the image data for the copy count designated by the copy count data, and causes the print part to execute the print process via the print controller based on the generated image data for the copy count.

10. The image forming device according to claim 9, wherein when the print process for the print data is interrupted as the print interruption command and the copy count change command are sequentially received from the data processing device, and when a copy count after change requested by the copy count change command is less than a copy count before change, if the copy count after change is greater than the copy count for which the printing has completed, the main controller resumes the print process, causes the print part to execute the print process for a remaining copy count, and causes the notification part to transmit notifications, which indicate that the copy count has been changed and that the print process has resumed, to the data processing device, and if the copy count after change is equal to or less than the copy count for which the printing has completed, the main controller ends the print process and causes the notification part to transmit notifications, which indicate that the print process has completed and that the print process has been cancelled, to the data processing device.

11. The image forming device according to claim 9, wherein when the print process for the print data is interrupted after the print interruption command and the copy count change command are sequentially received from the data processing device, and when the copy count after change is zero, the main controller cancels the print process and causes the notification part to transmit a notification, which indicates that the print process has been canceled, to the data processing device.

12. The image forming device according to claim 9, wherein when the print process for the print data is interrupted as the print interruption command and the copy count change command are sequentially received from the data processing device, and when the copy count after change is greater than the copy count before change, the main controller resumes the print process, and causes the notification part to transmit notifications, which indicate that the copy count has been changed and that the print process has been resumed, to the data processing device.

13. The image forming device according to claim 9, wherein either when the print interruption command is continuously received from the data processing device, or when the print interruption command and the copy count change command that designates the copy count as zero are sequentially received from the data processing device, the main controller cancels the print process and causes the notification part to transmit a notification, which indicates that the print process has been canceled, to the data processing device.

14. The image forming device according to claim 8, wherein the print data includes page images of multiple different pages, and the print part executes the print process for each of the page images as the same times as a number indicated by the copy count.

15. An image forming device that forms an image based on print data generated by a data processing device, comprising:

a communication part that executes communication with the data processing device;

a memory part that stores control commands and the print data that includes setting data received from the data processing device;

a print part that executes a print process based on the print data;

a notification part that generates a notification to the data processing device and transmits the notification via the communication part; and a main controller that controls operation of the communication part, the memory part, the print part and the notification part, wherein when the print data is received, with which the setting data that includes copy count data designating a copy count is attached, the main controller stores the print data, received from the data processing device, in the memory part, and causes the print part to execute the print process for the copy count based on the print data, and when a print interruption command that instructs interruption of the print process of the print data and a copy count change command that instructs a change in the copy count for the print data are received, the main controller specifies an unprocessed copy count based on history data and the copy count change command, and causes the print part to execute the print process for the unprocessed copy count based on the print data, and the history data that includes a printed copy count at time of interruption is stored in the memory part.

* * * * *